US010203615B2

(12) United States Patent
Horiguchi et al.

(10) Patent No.: US 10,203,615 B2
(45) Date of Patent: Feb. 12, 2019

(54) ELECTROPHOTOGRAPHIC PHOTORECEPTOR, IMAGE FORMING APPARATUS, IMAGE FORMING METHOD, AND METHOD OF PRODUCING ELECTROPHOTOGRAPHIC PHOTORECEPTOR

(71) Applicant: KONICA MINOLTA, INC., Tokyo (JP)

(72) Inventors: Haruo Horiguchi, Koganei (JP); Toshiyuki Fujita, Hachioji (JP); Tomohiro Oshiyama, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/837,737

(22) Filed: Dec. 11, 2017

(65) Prior Publication Data

US 2018/0173120 A1 Jun. 21, 2018

(30) Foreign Application Priority Data

Dec. 16, 2016 (JP) ..... 2016-243867

(51) Int. Cl.
*G03G 5/147* (2006.01)
*G03G 5/04* (2006.01)
(Continued)

(52) U.S. Cl.
CPC ..... *G03G 5/04* (2013.01); *G03G 5/0507* (2013.01); *G03G 5/0592* (2013.01); *G03G 5/102* (2013.01);
(Continued)

(58) Field of Classification Search
CPC ..... G03G 5/14708; G03G 5/047; G03G 5/06; G03G 5/0614
See application file for complete search history.

(56) References Cited

U.S. PATENT DOCUMENTS

2015/0261107 A1* 9/2015 Kodama ..... G03G 5/14704 430/57.1

FOREIGN PATENT DOCUMENTS

JP 2009-080403 * 4/2009 ..... G03G 5/147
JP 2013061625 A 4/2013

OTHER PUBLICATIONS

Translation of JP 2009-080403 published Apr. 2009.*

* cited by examiner

*Primary Examiner* — Peter L Vajda
(74) *Attorney, Agent, or Firm* — Lucas & Mercanti, LLP

(57) ABSTRACT

An electrophotographic photoreceptor according to the present invention includes a conductive support, a photosensitive layer, and a protective layer disposed in sequence. The protective layer includes a cured product of a composition containing a radically polymerizable compound, a charge transporting material exhibiting a maximal absorption wavelength of 405±50 nm, and a photopolymerization initiator of a single-molecule system; and a following Expression (A) is satisfied:

$$\Delta G = Eox(D/D^+) - Ered(A^-/A) - E^* \leq -0.2 \text{ [eV]} \quad \text{Expression (A):}$$

$\Delta G$ represents a free energy change, $Eox(D/D^+)$ represents an oxidation potential of the charge transporting material, $Ered(A^-/A)$ represents a reduction potential of the photopolymerization initiator, and $E^*$ represents an excitation energy of the charge transporting material.

8 Claims, 2 Drawing Sheets

(51) Int. Cl.

| | |
|---|---|
| ***G03G 5/10*** | (2006.01) |
| ***G03G 15/00*** | (2006.01) |
| ***G03G 5/05*** | (2006.01) |

(52) U.S. Cl.

CPC ..... *G03G 5/14704* (2013.01); *G03G 5/14708* (2013.01); *G03G 5/14791* (2013.01); *G03G 15/75* (2013.01)

ELECTROPHOTOGRAPHIC PHOTORECEPTOR, IMAGE FORMING APPARATUS, IMAGE FORMING METHOD, AND METHOD OF PRODUCING ELECTROPHOTOGRAPHIC PHOTORECEPTOR

CROSS-REFERENCE TO RELATED APPLICATIONS

Japanese Patent Application No. 2016-243867 filed on Dec. 16, 2016, including description, claims, drawings, and abstract of the entire disclosure is incorporated herein by reference in its entirety.

BACKGROUND

Technological Field

The present invention relates to an electrophotographic photoreceptor, an image forming apparatus, an image forming method, and a method of producing the electrophotographic photoreceptor. In particular, the present invention relates to an electrophotographic photoreceptor that can achieve excellent potential stability and high wear resistance, an image forming apparatus including the electrophotographic photoreceptor, an image forming method using the electrophotographic photoreceptor, and the method of producing the electrophotographic photoreceptor.

Description of the Related Art

Conventionally, there is provided an image forming apparatus that forms an image on a sheet by charging the surface of an electrophotographic photoreceptor, forming an electrostatic latent image on the photoreceptor by exposing the photoreceptor, developing the formed electrostatic latent image using a developer, and transferring the developed image onto a sheet.

A generally used electrophotographic photoreceptor includes a conductive support, an intermediate layer, a charge generating layer, a charge transporting layer, a protective layer, etc. disposed in sequence. In order to achieve long service life and high image quality in such electrophotographic photoreceptor, the protective layer includes a curable binder resin, N-type metal oxide particles, and a charge transporting material (CTM) in the technique according to, for example, Japanese Unexamined Patent Application Publication No. 2013-61625.

However, the electrophotographic photoreceptor has low potential stability according to the conventional technique described above. Therefore, long service life and high image quality cannot be sufficiently achieved under more severe conditions for image forming, for example, without a precleaner, with high line speed for driving, under low-temperature and low-humidity environment, and the like.

For obtaining a photoreceptor having high potential stability, the protective layer needs to contain a charge transporting material with high hole transportability. While a generally-used charge transporting material exhibits an absorption wavelength of less than 400 nm, the charge transporting material with high hole transportability has a large π-conjugated system, which shifts the absorption wavelength of the charge transporting material to a long wavelength side. When the protective layer includes the charge transporting material having high hole transportability, the ultraviolet rays for curing the curable binder resin is absorbed by the charge transporting material. Accordingly, the polymerization reaction rate of the resin constituting the protective layer is lowered and thereby causes problems of deterioration in hardness and wear resistance of the protective layer.

SUMMARY

The present invention has been attained in consideration of the above problems and circumstances described above. An object of the present invention is to provide an electrophotographic photoreceptor that can achieve excellent potential stability and high wear resistance, an image forming apparatus including the electrophotographic photoreceptor, an image forming method using the electrophotographic photoreceptor, and the method of producing the electrophotographic photoreceptor.

In order to achieve at least one of the abovementioned objects, the present inventors, who have conducted studies on the causes of the problems, have consequently found that an electrophotographic photoreceptor with excellent potential stability and high wear resistance can be achieved by incorporating a charge transporting material exhibiting a maximal absorption wavelength of a specific range and a photopolymerization initiator of a single-molecule system into a protective layer and by satisfying a specific expression regarding the charge transporting material and the photopolymerization initiator.

To achieve at least one of the abovementioned objects, according to an aspect of the present invention, an electrophotographic photoreceptor reflecting one aspect of the present invention includes a conductive support, a photosensitive layer, and a protective layer disposed in sequence, wherein the protective layer includes a cured product of a composition containing a radically polymerizable compound, a charge transporting material exhibiting a maximal absorption wavelength of 405±50 nm, and a photopolymerization initiator of a single-molecule system; and a following Expression (A) is satisfied:

$$\Delta G = Eox(D/D^{+}) - Ered(A^{-}/A) - E^{*} \leq -0.2 \text{ [eV]} \qquad \text{Expression (A):}$$

where ⊿G represents a free energy change, $Eox(D/D^{+})$ represents an oxidation potential of the charge transporting material, $Ered(A^{-}/A)$ represents a reduction potential of the photopolymerization initiator, and E* represents an excitation energy of the charge transporting material.

According to another aspect of the present invention, there is provided an image forming apparatus including the electrophotographic photoreceptor according to the present invention.

According to another aspect of the present invention, there is provided an image forming method using the electrophotographic photoreceptor according to the present invention.

According to another aspect of the present invention, there is provided a method of producing an electrophotographic photoreceptor including a conductive support, a photosensitive layer, and a protective layer disposed in sequence, the method including:

forming the protective layer by curing a composition through ultraviolet rays irradiation, the composition containing a radically polymerizable compound, a charge transporting material exhibiting a maximal absorption wavelength of 405±50 nm, and a photopolymerization initiator of a single-molecule system, wherein a following Expression (A) is satisfied:

$$\Delta G = Eox(D/D^+) - Ered(A^-/A) - E^* \leq -0.2 \text{ [eV]} \quad \text{Expression (A):}$$

where $\Delta G$ represents a free energy change, $Eox(D/D^+)$ represents an oxidation potential of the charge transporting material, $Ered(A^-/A)$ represents a reduction potential of the photopolymerization initiator, and $E^*$ represents an excitation energy of the charge transporting material.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
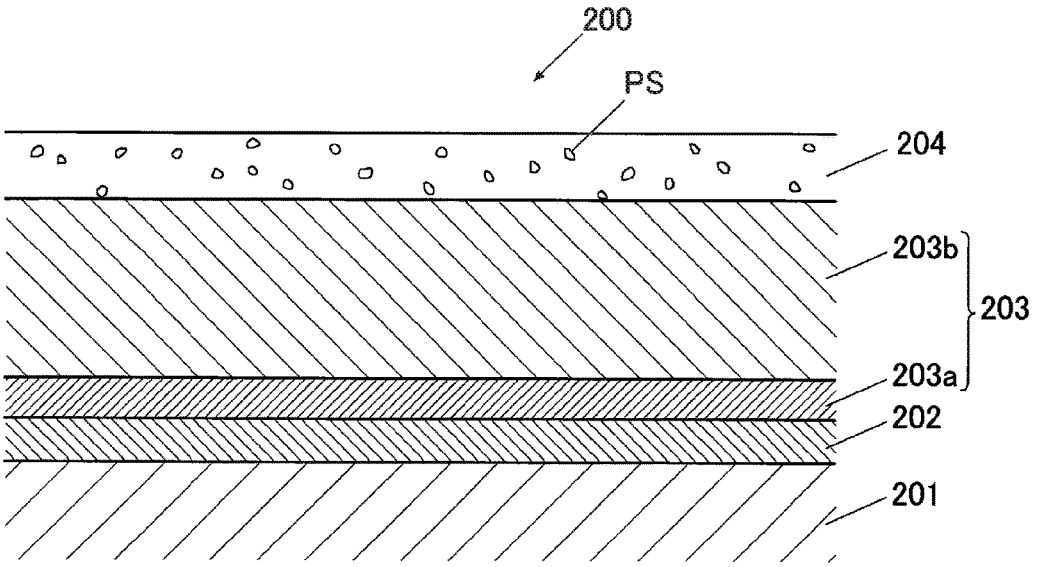
FIG. 1 is a schematic cross-sectional view of an exemplary configuration of the electrophotographic photoreceptor of the present invention.

Hereinafter, one or more embodiments of the present invention will be described with reference to the drawings. However, the scope of the invention is not limited to the disclosed embodiments.

The mechanisms and operations that establish the advantages of the present invention are not clarified but are inferred as follows.

When the protective layer includes the charge transporting material with high hole transportability in order to improve potential stability of the electrophotographic photoreceptor as in the conventional techniques, the charge transporting material exhibits an absorption wavelength which is almost the same as the wavelength of ultraviolet rays used in the curing process. The resulting protective layer exhibits insufficient wear resistance because the curing reaction is inhibited. According to the present invention, the properties of the charge transporting material having high hole transportability and the photopolymerization initiator of a single-molecule system satisfy Expression (A). The photopolymerization initiator is sensitized when irradiated with ultraviolet rays so that the curing reaction of the protective layer is facilitated. As a result, there is provided an electrophotographic photoreceptor having excellent potential stability and high wear resistance.

The photopolymerization initiator is sensitized by the following process: the charge transporting material is excited by absorbing ultraviolet rays; the charge transporting material in an excited state affects the photopolymerization initiator; and the energy level of the charge transporting material transits to lower level and the photopolymerization initiator is in an excited state. The sensitization of photopolymerization initiator theoretically follows the Rehmweller equation. When the reduction potential of the photopolymerization initiator is lower than that of the charge transporting material, in other words, when the free energy change ($\Delta G$) is less than zero ($\Delta G<0$), the photopolymerization initiator is allowed to be sensitized. However, as a matter of fact, the free energy change is affected by various errors due to the environment (for example, contained solvent, monomer, and the like) around the charge transporting material and the photopolymerization initiator. Accordingly, the free energy change ($\Delta G$) is required to be lower than the theoretical value. The present inventors have further found that the photopolymerization initiator can be sensitized highly enough to perform curing reaction of the protective layer when Expression (A) according to the present invention is satisfied.

The electrophotographic photoreceptor of the present invention includes a conductive support and at least a photosensitive layer and a protective layer disposed thereon in sequence. The protective layer includes a cured product of a composition containing a radically polymerizable compound, a charge transporting material exhibiting a maximal absorption wavelength of 405±50 nm, and a photopolymerization initiator of a single-molecule system. The properties of the charge transporting material and the photopolymerization initiator preferably satisfy the following Expression (A). These technical characteristics are common to or correspond to the embodiments of the present invention described below.

In an embodiment of the present invention, the photopolymerization initiator preferably includes an acyl phosphine oxide structure or an O-acyl oxime structure. According to the embodiment, the photopolymerization initiator has lower reduction potential and thereby can be easily sensitized. As a result, curing reaction of the protective layer can be performed at a high reaction rate and the wear resistance can be further improved.

In an embodiment of the present invention, the protective layer preferably contains metal oxide particles. According to the embodiment, the strength of the protective layer is improved and the wear resistance can be further improved.

In an embodiment of the present invention, the metal oxide particle preferably has a reactive organic group. The metal oxide particle thereby forms a chemical bond with the radically polymerizable compound. The strength of the protective layer is improved and the wear resistance can be further improved.

The image forming apparatus according to the present invention includes the electrophotographic photoreceptor described above. The maintenance frequency can be thereby reduced and images having sufficiently high quality can be formed even under severe conditions for image formation.

The image forming method according to the present invention uses the electrophotographic photoreceptor described above. Images of sufficiently high quality can be thereby formed even under severe image forming conditions.

The method of producing an electrophotographic photoreceptor according to the present invention includes a conductive support, a photosensitive layer, and a protective layer disposed in sequence. The method includes forming the protective layer by curing a composition containing a radically polymerizable compound, a charge transporting material exhibiting a maximal absorption wavelength of 405±50 nm, and a photopolymerization initiator of a single-molecule system, through ultraviolet rays irradiation. The properties of the charge transporting material and the photopolymerization initiator preferably satisfy the following Expression (A). An electrophotographic photoreceptor having excellent potential stability and high wear resistance can be thereby provided.

$$\Delta G = Eox(D/D^+) - Ered(A^-/A) - E^* \leq -0.2 \text{ [eV]} \quad \text{Expression (A):}$$

The components of the present invention and embodiments and aspects for implementing the present invention will now be described in detail. As used herein, the term "to" between two numerical values indicates that the numeric values before and after the term are inclusive as the lower limit value and the upper limit value, respectively.

<<Electrophotographic Photoreceptor>>

The electrophotographic photoreceptor of the present invention includes a conductive support, a photosensitive layer, and a protective layer disposed in sequence. The protective layer includes a cured product of a composition containing a radically polymerizable compound, a charge transporting material exhibiting a maximal absorption wavelength of 405±50 nm, and a photopolymerization initiator of a single-molecule systemphotopolymerization, and the following Expression (A) is satisfied:

$$\Delta G = Eox(D/D^{+}) - Ered(A^{-}/A) - E^{*} \leq -0.2 \text{ [eV]} \qquad \text{Expression (A):}$$

(In Expression (A), ⊿G represents a free energy change, $Eox(D/D^{+})$ represents an oxidation potential of the charge transporting material, $Ered(A^{-}/A)$ represents a reduction potential of the photopolymerization initiator, and E* represents an excitation energy of the charge transporting material.)

The protective layer may include a plurality of charge transporting materials exhibiting a maximal absorption wavelength of 405±50 nm and a plurality of photopolymerization initiator of a single-molecule system. When protective layer includes a plurality of charge transporting materials according to the present invention, the properties of each of the charge transporting materials and at least one of the photopolymerization initiator preferably satisfy the above Expression (A).

Thus, it is necessary that the protective layer includes at least one charge transporting material exhibiting a maximal absorption wavelength of 405±50 nm and one photopolymerization initiator of a single-molecule system, and that their properties satisfy the Expression (A). Furthermore, a known charge transporting material and a known photopolymerization initiator may be included. It is not necessary that the known charge transporting material exhibits a maximal absorption wavelength of 405±50 nm or that the known photopolymerization initiator is a single-molecule system.

The photosensitive layer has both a function of absorbing light to generate charges and a function of transporting charges. The photosensitive layer may have a single-layer configuration containing a charge generating material and a charge transporting material, or may have a multilayer configuration including a charge generating layer containing a charge generating material and a charge transporting layer containing a charge transporting material. An intermediate layer may optionally be disposed between the conductive support and the photosensitive layer. The photosensitive layer may have any other layer configuration. Specific examples of the layer configuration including a surface protective layer are as follows:

(1) A layer configuration including a conductive support, a photosensitive layer, and a protective layer disposed in sequence, the photosensitive layer including a charge generating layer and a charge transporting layer.
(2) A layer configuration including a conductive support, a single photosensitive layer containing a charge transporting material and a charge generating material, and a protective layer disposed in sequence.
(3) A layer configuration including a conductive support, an intermediate layer, a photosensitive layer, and a surface protective layer disposed in sequence, the photosensitive layer including a charge generating layer and a charge transporting layer.
(4) A layer configuration including a conductive support, an intermediate layer, a single photosensitive layer containing a charge transporting material and a charge generating material, and a surface protective layer disposed in sequence.

The electrophotographic photoreceptor of the present invention may have any of the aforementioned layer configurations (1) to (4) described above. Of these, particularly preferred is layer configuration (3) described above.

FIG. 1 is a cross-sectional view of an exemplary layer configuration of the electrophotographic photoreceptor of the present invention.

As illustrated in FIG. 1, the electrophotographic photoreceptor 200 of the present invention includes a conductive support 201, an intermediate layer 202, a photosensitive layer 203, and a protective layer 204 disposed in sequence.

The photosensitive layer 203 includes a charge generating layer 203*a* and a charge transporting layer 203*b*.

The protective layer 204 contains metal oxide particles PS.

The electrophotographic photoreceptor of the present invention is an organic photoreceptor. The "organic photoreceptor" refers to an electrophotographic photoreceptor in which an organic compound exhibits at least one of the functions essential for the photoreceptor, i.e., a charge generating function and a charge transporting function. Examples of the organic photoreceptor include a photoreceptor composed of a known organic charge generating material or a known charge transporting material, a photoreceptor composed of a polymer complex exhibiting a charge generating function and a charge transporting function, and the like.

(Calculation of ⊿G in Expression (A))

⊿G in Expression (A) according to the present invention can be calculated as follows.

The $Eox(D/D^{+})$ in Expression (A) is similar to the negation of HOMO of the charge transporting material according to the present invention and the $Ered(A^{-}/A)$ is similar to the negation of LUMO of the photopolymerization initiator according to the present invention. The HOMO, LUMO, and E* of the charge transporting material and the photopolymerization initiator can be measured using Gaussian 09 (Revision C.01, M. J. Frisch, G. W. Trucks, H. B. Schlegel, G. E. Scuseria, M. A. Robb, J. R. Cheeseman, G. Scalmani, V. Barone, B. Mennucci, G. A. Petersson, H. Nakatsuji, M. Caricato, X. Li, H. P. Hratchian, A. F. Izmaylov, J. Bloino, G. Zheng, J. L. Sonnenberg, M. Hada, M. Ehara, K. Toyota, R. Fukuda, J. Hasegawa, M. Ishida, T. Nakajima, Y. Honda, O. Kitao, H. Nakai, T. Vreven, J. A. Montgomery, Jr., J. E. Peralta, F. Ogliaro, M. Bearpark, J. J. Heyd, E. Brothers, K. N. Kudin, V. N. Staroverov, T. Keith, R. Kobayashi, J. Normand, K. Raghavachari, A. Rendell, J. C. Burant, S. S. Iyengar, J. Tomasi, M. Cossi, N. Rega, J. M. Millam, M. Klene, J. E. Knox, J. B. Cross, V. Bakken, C. Adamo, J. Jaramillo, R. Gomperts, R. E. Stratmann, O. Yazyev, A. J. Austin, R. Cammi, C. Pomelli, J. W. Ochterski, R. L. Martin, K. Morokuma, V. G. Zakrzewski, G. A. Voth, P. Salvador, J. J. Dannenberg, S. Dapprich, A. D. Daniels, O. Farkas, J. B. Foresman, J. V. Ortiz, J. Cioslowski, and D. J. Fox, Gaussian, Inc., Wallingford Conn., 2010) with B3LYP as a functional and 6-31G(d) as a base function for a calculation method. There is no limitation to the software, the same results may be obtained with any software.

Each value can be thereby obtained. ⊿G can be calculated according to the above Expression (A).

<<Projective Layer>>

The protective layer according to the present invention contains a cured product of a composition containing a radically polymerizable compound (a binder resin), a charge transporting material exhibiting a maximal absorption wavelength of 405±50 nm, and a photopolymerization initiator of a single-molecule system. The protective layer according to the present invention may further contain metal oxide particles. The materials for the protective layer will be described below.

[1] Photopolymerization Initiator

The protective layer according to the present invention contains any photopolymerization initiator of a single-molecule system as long as the above Expression (A) is satisfied. For example, the photopolymerization initiator includes an acyl phosphine oxide structure or an O-acyl oxime structure. They may be used alone or in combination. In the present invention, a photopolymerization initiator of a single-molecule system is defined as the one that can independently function as a photopolymerization initiator as a single molecule. The one that functions as a photopolymerization initiator only as two or more molecules is not included in the photopolymerization initiator of a single-molecule system according to the present invention.

Examples of the photopolymerization initiator including an acyl phosphine oxide structure are described below.

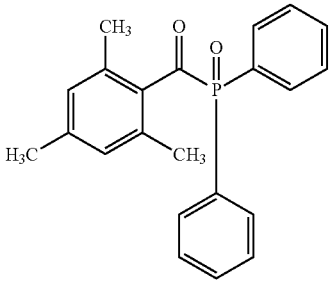

Irgacure TPO

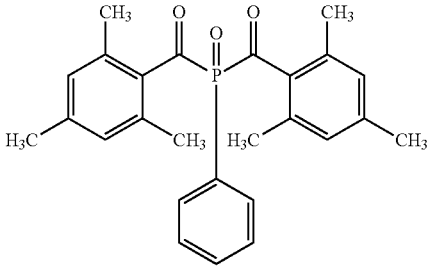

Irgacure 819

Irgacure 819 is preferred among Irgacure TPO and Irgacure 819 described above.

In the present invention, the O-acyl oxime structure is preferably represented by the following Formula (1).

Formula (1)

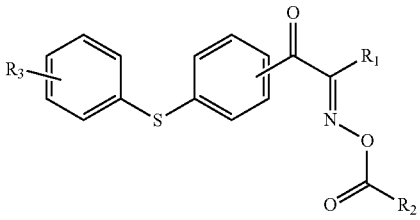

In Formula (1), $R_1$ and $R_2$ each independently represent a moiety selected from the group consisting of a hydrogen atom, an alkyl group having one to six carbon atoms and optionally having a substituent, a cycloalkyl group having three to six carbon atoms and optionally having a substituent, and an aryl group optionally having a substituent.

$R_3$ represents a moiety selected from the group consisting of a hydrogen atom, an alkyl group having one to six carbon atoms and optionally having a substituent, an alkoxy group having one to six carbon atoms and optionally having a substituent, an aryl group optionally having a substituent, a halogen atom, a cyano group, a nitro group, a hydroxy group, and a carbonyl group optionally having a substituent.

Examples of the compound having a structure represented by the above Formula (1) are described below.

B-1

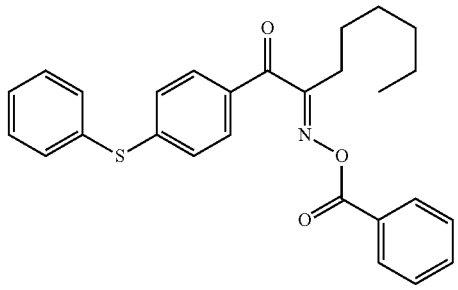

(OXE01)

B-2

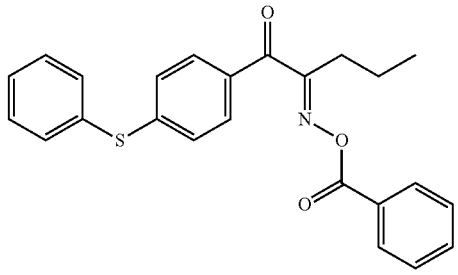

B-3

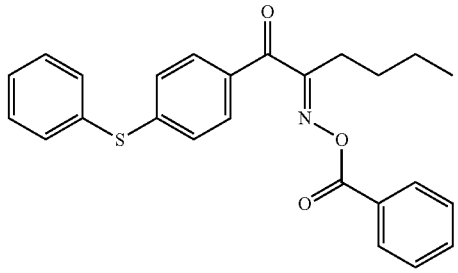

B-4

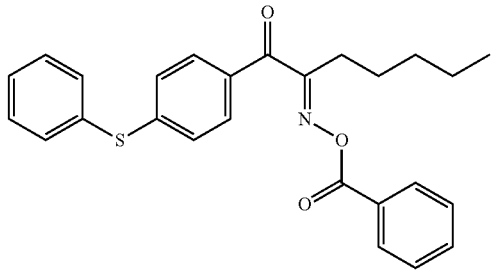

-continued
B-5
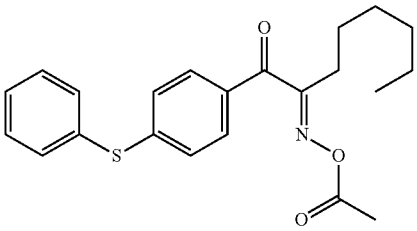
B-6
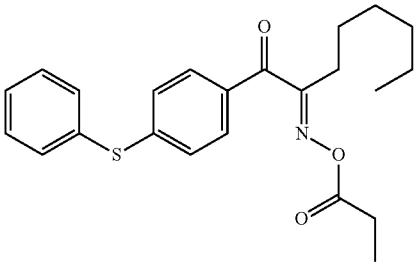
B-7
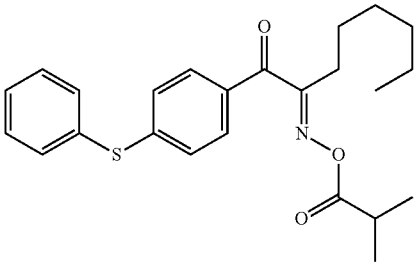
B-8
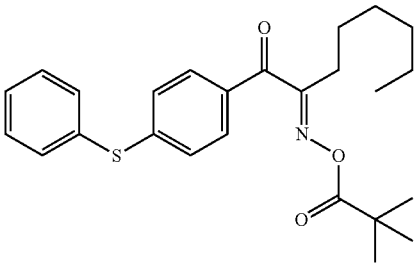
B-9
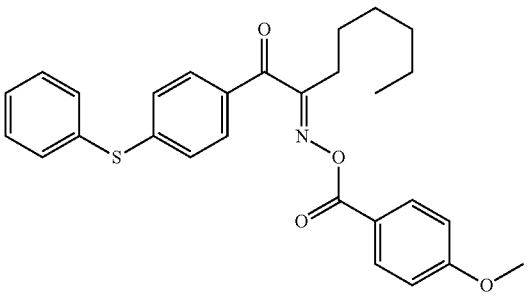
-continued
B-10
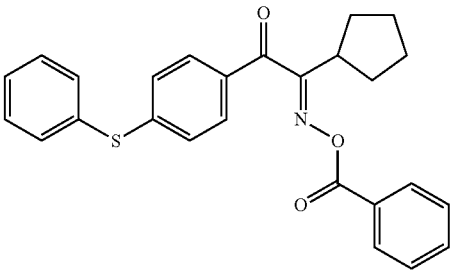
B-11
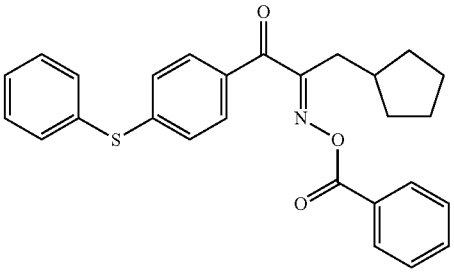
B-12
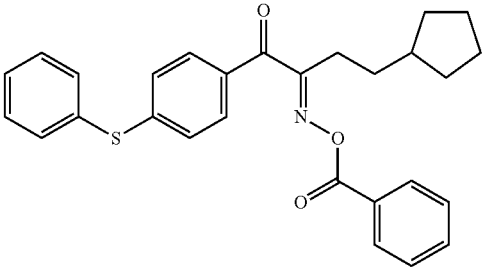
B-13
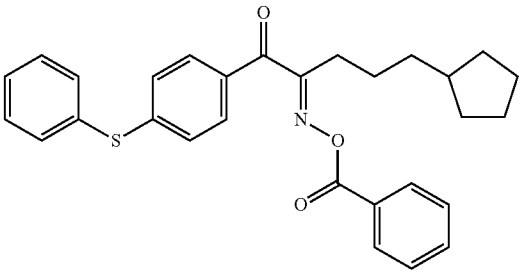
B-14
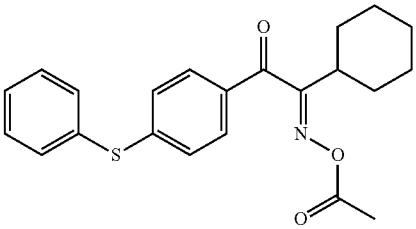
B-15
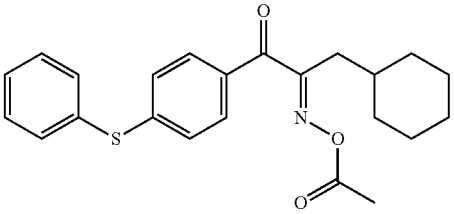

-continued
B-16
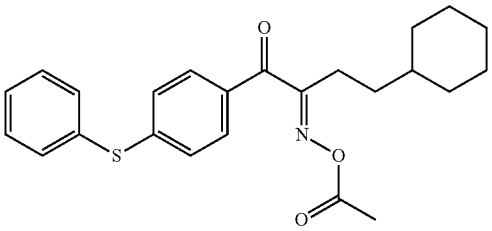
B-17
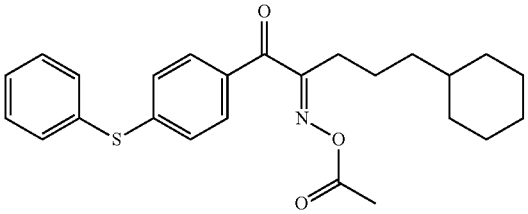
B-18
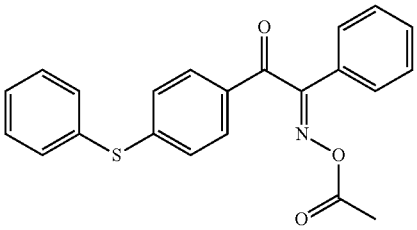
B-19
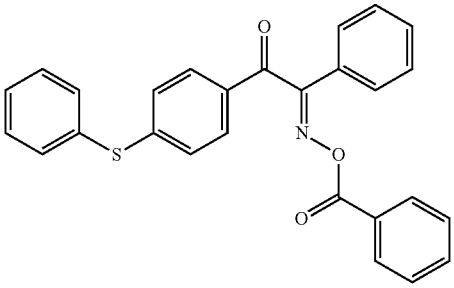
B-20
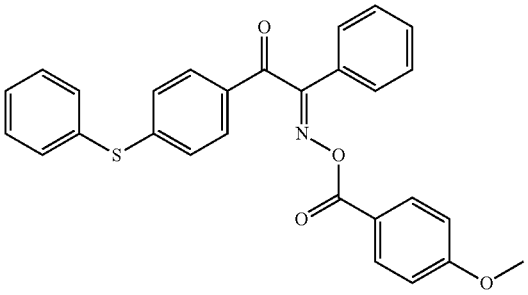
-continued
B-21
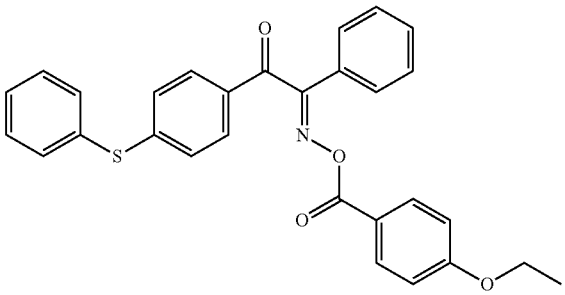
B-22
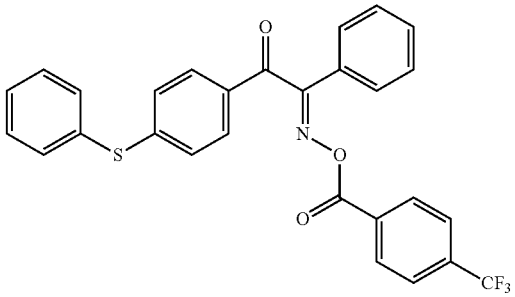
B-23
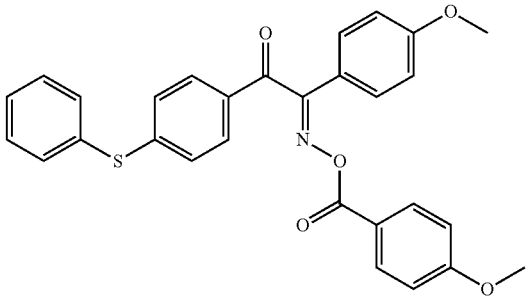
B-24
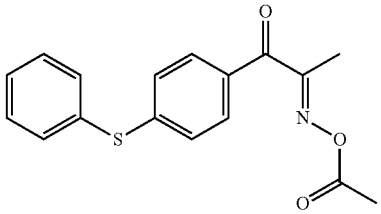
B-25
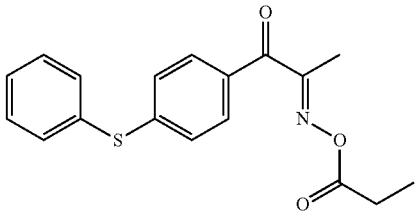

-continued
B-26
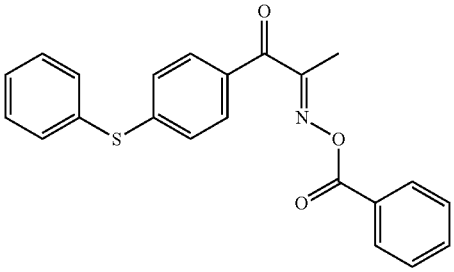
B-27
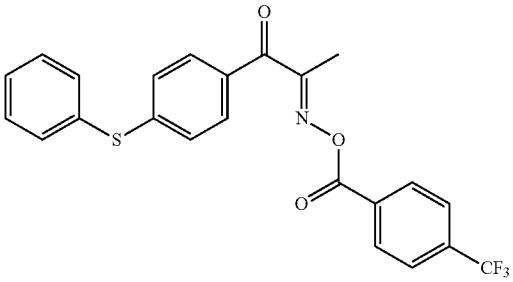
B-28
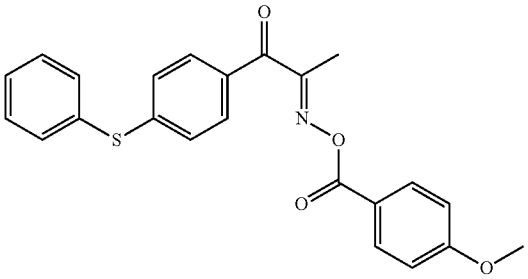
B-29
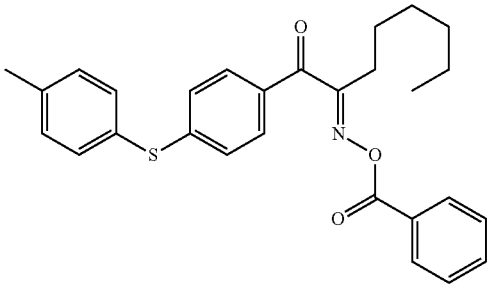
B-30
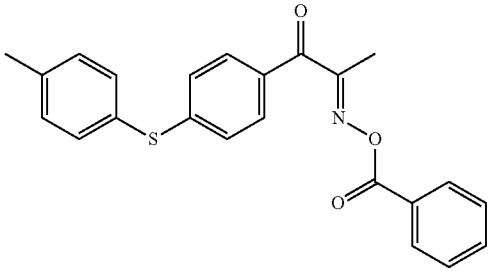
-continued
B-31
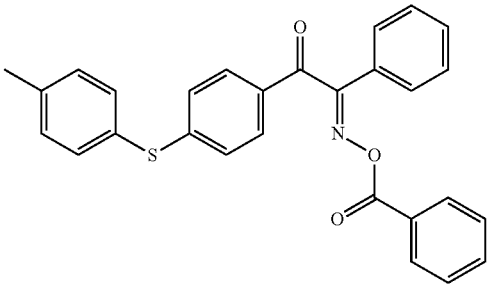
B-32
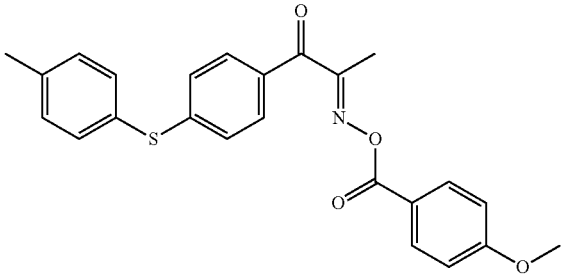
B-33
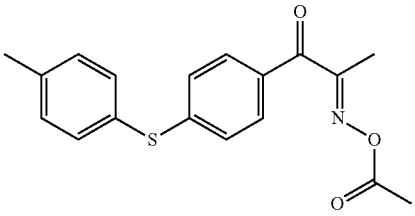
B-34
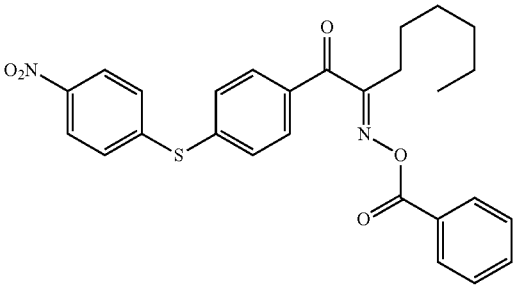
B-35
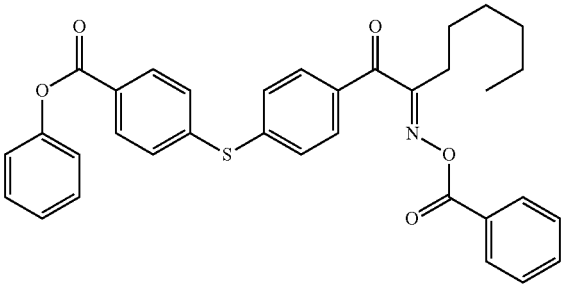

-continued

B-36

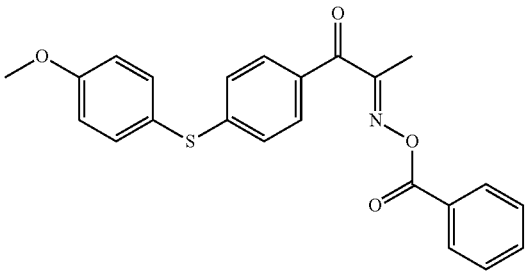

B-37

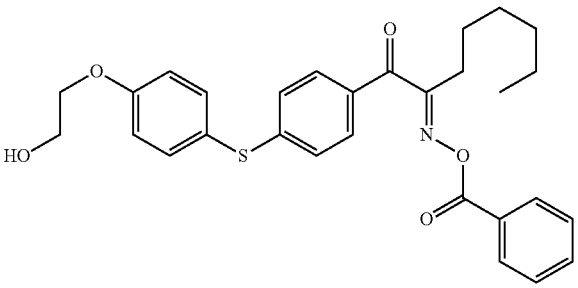

B-38

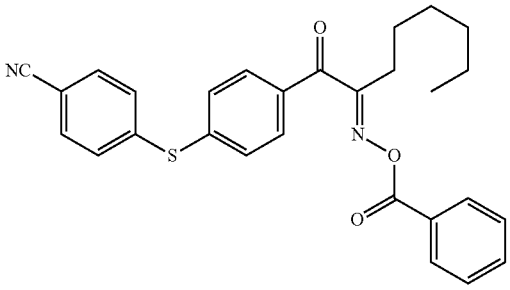

B-39

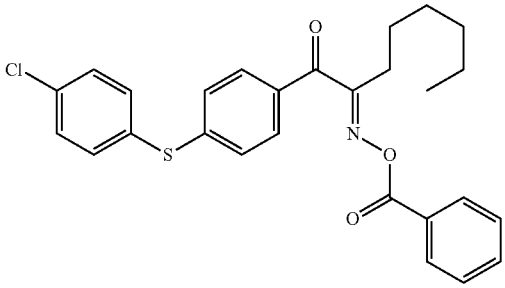

The amount of the photopolymerization initiators according to the present invention is preferably 0.1 to 20 parts by mass, more preferably 0.5 to 10 parts by mass, relative to 100 parts by mass of the radically polymerizable compound.

As described above, the protective layer may further include a known photopolymerization initiator other than the photopolymerization initiator according to the present invention. The amount of the photopolymerization initiators according to the present invention is preferably 20 volume % or more, more preferably 30 volume % or more, relative to the total amount of the photopolymerization initiators included in the protective layer.

Examples of commercially available products of the photopolymerization initiator having the O-acyl oxime structure include above-described exemplary compound B-1 (Irgacure OXE01, manufactured by BASF Japan Ltd.) and PBG-305 and PBG-329, which are O-acyl oxime initiators having a disulfide structure (manufactured by Changzhou Tronly New Electronic Materials Co., Ltd.).

[2] Radically Polymerizable Compound

The radically polymerizable compound according to the present invention is preferably a monomer having a radically polymerizable group that is polymerized (cured) by a radical polymerization initiator into a binder resin for use in a photoreceptor. Examples of the binder resin include a polystyrene resin and a polyacrylate resin. In the present invention, ultraviolet rays are defined as electromagnetic waves having a wavelength of 10 to 400 nm.

The radically polymerizable compound is preferably a crosslinkable polymerizable compound for maintaining high durability. The crosslinkable polymerizable compound is, for example, a polymerizable compound having two or more radically polymerizable functional groups (hereinafter may be referred to as "polyfunctional radically polymerizable compound").

The polyfunctional radically polymerizable compound may be used in combination with a compound having one radically polymerizable functional group (hereinafter may be referred to as "monofunctional radically polymerizable compound"). If the monofunctional radically polymerizable compound is used, the amount of the compound is preferably 20 mass % or less relative to the total amount of monomers for forming the binder resin.

Examples of the radically polymerizable functional group include a vinyl group, an acryloyl group, and a methacryloyl group.

Examples of the particularly preferred polyfunctional radically polymerizable compounds include acrylic monomers having two or more acryloyl groups ($CH_2{=}CHCO{-}$) or methacryloyl groups ($CH_2{=}CCH_3CO{-}$), which are radically polymerizable functional groups, and oligomers derived from the monomers. These monomers and oligomers can be cured with a small amount of light or within a short period of time. Thus, the resin is preferably an acrylic resin formed of an acrylic monomer or an oligomer derived therefrom.

In the present invention, polyfunctional radically polymerizable compounds may be used alone or in combination. Such a polyfunctional radically polymerizable compound may be a monomer or an oligomer derived therefrom.

Examples of the polyfunctional radically polymerizable compound are described below.

M1

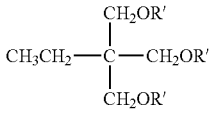

M2

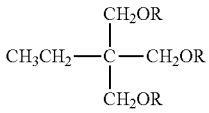

M3

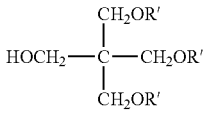

M4

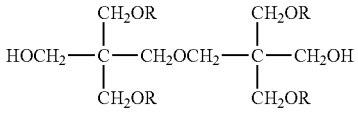

-continued

M5

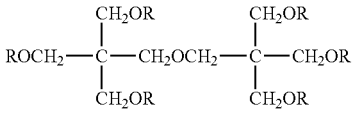

M6

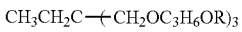

M7

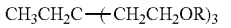

M8

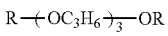

M9

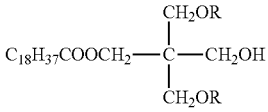

M10

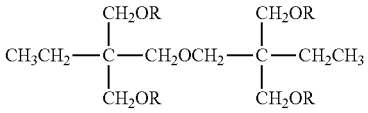

M11

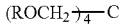

M12

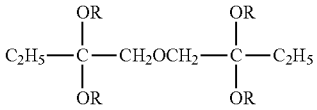

M13

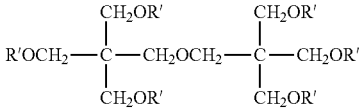

M14

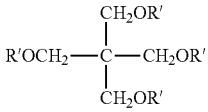

In the formulae representing the above exemplary compounds M1 to M14, R represents an acryloyl group ($CH_2{=}CHCO{-}$) and R represents a methacryloyl group ($CH_2{=}CCH_3CO{-}$).

[3] Charge Transporting Material

The charge transporting material according to the present invention preferably exhibits a maximal absorption wavelength of 405±50 nm in an absorption spectrum. The charge transporting material may be of a common type having a charge transporting function, and preferably has a molecular weight of 250 to 800. When a charge transporting material has a molecular weight of 250 or more, charge transporting function can be prevented from decreasing and thereby the residual image formation can be sufficiently reduced. When a charge transporting material has a molecular weight of 800 or less, the surface hardness of the protective layer can be easily maintained.

The charge transporting material according to the present invention preferably exhibits a maximal absorption wavelength of 405±50 nm in an absorption spectrum and has improved hole transportability. An electrophotographic photoreceptor exhibiting excellent potential stability can be thereby provided.

In the case that the protective layer includes a charge transporting material that absorbs light around 405 nm (the optical absorption wavelength of the photopolymerization initiator for curing (polymerization) reaction), that is, a charge transporting material having high hole transportability, the photopolymerization initiator cannot receive sufficient energy for UV curing. As a result, the protective layer cannot be cured sufficiently (inhibition of curing). In contrast, in the present invention, excellent potential stability and improved wear resistance can be achieved because the protective layer can be cured without causing insufficient curing by combination use of the charge transporting material and the photopolymerization initiator whose properties satisfy Expression (A)

The maximal point of the absorption peak is determined as the maximal absorption wavelength of the charge transporting material according to the present invention, which is measured from a solution of the charge transporting material dissolved in tetrahydrofuran at a concentration of $1.0\times10^{-5}$ mol/L with a common absorption spectrophotometer at the temperature of 25° C. The maximal absorption wavelength is not necessarily the maximum absorption wavelength and there may be plural maximal points in the absorption wavelength.

Examples of the charge transporting material (compound) usable in the present invention are described below, but are not limited thereto.

| Example of Material | Structure | Maximum Absorption Wavelength [nm] |
|---|---|---|
| CTM-1 | 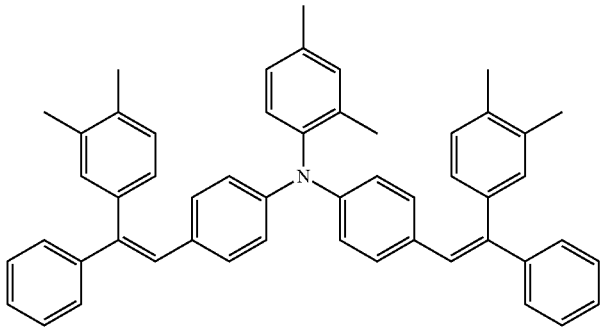 | 384 |

-continued
| | | |
|---|---|---|
| CTM-2 | 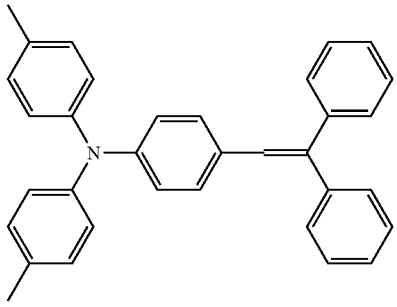 | 370 |
| CTM-3 | 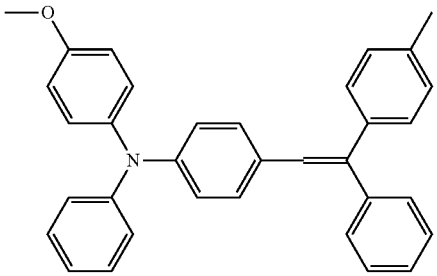 | 368 |
| CTM-4 | 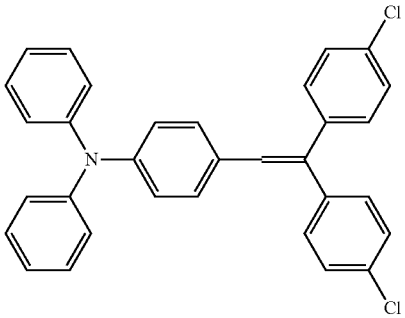 | 375 |
| Example of Material | Structure | Molecular Weight |
|---|---|---|
| CTM-141 | 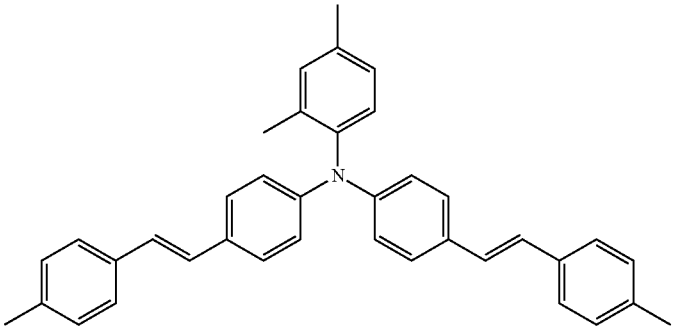 | 505.69 |
| CTM-143 | 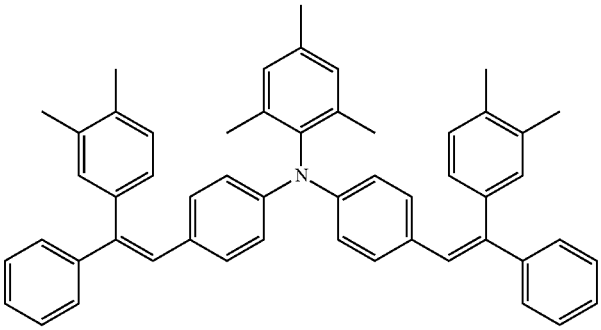 | 699.96 |

-continued

| | | |
|---|---|---|
| CTM-144 | 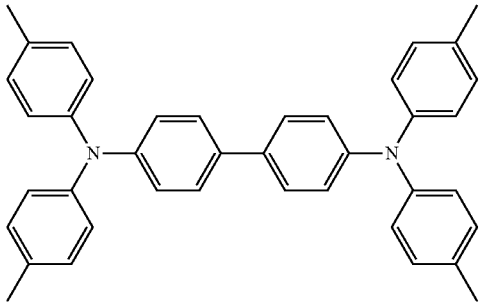 | 544.73 |
| CTM-145 | 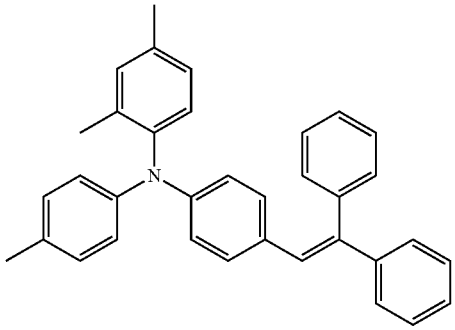 | 465.63 |
| CTM-146 | 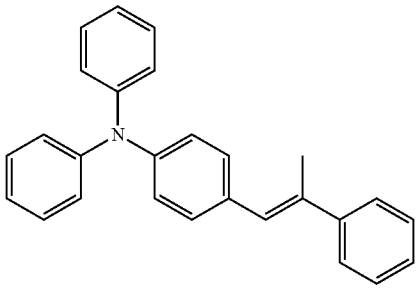 | 361.48 |
| CTM-147 | 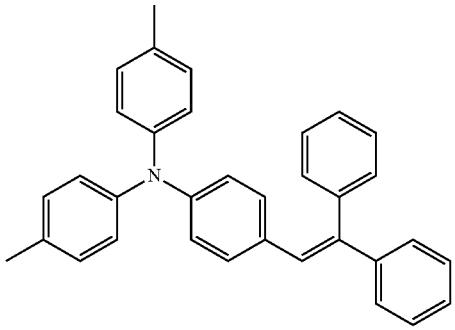 | 451.60 |

The aforementioned charge transporting material can be synthesized by any known process; for example, the process described in Japanese Unexamined Patent Application Publication No. 2006-143720.

The molecular weight of the charge transporting material is displayed with two-digit accuracy after the decimal point.

The amount of the charge transporting material according to the present invention is preferably 10 to 100 parts by mass, more preferably 20 to 60 parts by mass, relative to 100 parts by mass of the radically polymerizable compound.

As described above, the protective layer may include a known charge transporting material other than the charge transporting material according to the present invention. The amount of the charge transporting material according to the present invention is preferably 50 volume % or more, more preferably 70 volume % or more, relative to the total amount of the charge transporting material included in the protective layer.

[4] Metal Oxide Particles

In the present invention, the protective layer preferably contains metal oxide particles.

The metal oxide particles according to the present invention are preferably microparticles of a metal oxide (inclusive of a transition metal oxide). Examples of the metal oxide particles include microparticles of a metal oxide, such as silica (silicon dioxide), magnesium oxide, zinc oxide, lead oxide, aluminum oxide, tantalum oxide, indium oxide, bismuth oxide, yttrium oxide, cobalt oxide, copper oxide, manganese oxide, selenium oxide, iron oxide, zirconium oxide, germanium oxide, tin oxide, titanium oxide, niobium oxide, molybdenum oxide, and vanadium oxide. Particularly preferred are microparticles of any of tin oxide, titanium oxide, zinc oxide, and alumina. The use of such microparticles can improve the wear resistance of the protective layer.

The metal oxide particles are preferably prepared by a generally known process, such as the gas-phase process, the chlorine process, the sulfuric acid process, the plasma process, or the electrolytic process.

The metal oxide particles have a number average primary particle size of preferably 1 to 300 nm, particularly preferably 3 to 100 nm.

The amount of the metal oxide particles is preferably 1 to 250 parts by mass, more preferably 10 to 200 parts by mass, relative to 100 parts by mass of the radically polymerizable compound.

[4.1] Determination of Metal Oxide Particle Size

The particle size (number average primary particle size) of the metal oxide particles is determined as follows: The particles are photographed at a magnification of 10,000 with a scanning electron microscope (manufactured by JEOL Ltd.), and the photographic image including randomly selected 300 particles (excluding agglomerated particles) read by a scanner is converted into a binary image with an automatic image analyzer "LUZEX (registered trademark) AP" with software version Ver. 1.32 (manufactured by NIRECO Corporation). The horizontal Feret's diameters of the particles are calculated, and the average value of the Feret's diameters is defined as the number average primary particle size. As used herein, a horizontal Feret's diameter refers to the length of a side (parallel to the x-axis) of a rectangle circumscribing a binarized image of a metal oxide particle.

[4.2] Surface Modification

In the present invention, the metal oxide particles preferably have a reactive organic group. In specific, from the viewpoint of dispersibility and wear resistance of the photoreceptor, the surfaces of the metal oxide particles are preferably modified with a surface modifier having a reactive organic group.

The surface modifier may be reactive with, for example, a hydroxy group present on the surfaces of unmodified metal oxide particles. Examples of such a surface modifier include silane coupling agents and titanium coupling agents.

In the present invention, a surface modifier having a reactive organic group is preferably used for further enhancing the hardness of the protective layer. The reactive organic group is more preferably a radically polymerizable functional group. The surface modifier having a radically polymerizable functional group can also react with the radically polymerizable compound included in the protective layer, and a strong protective film can be thereby formed.

The surface modifier having a radically polymerizable functional group is preferably a silane coupling agent having an acryloyl or methacryloyl group. Examples of the surface modifier having such a radically polymerizable functional group include known compounds described below.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2(OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_2$
S-34: $CH_2{=}CHCOO(CH_2)_2Si(CH_3)(OC_6H_5)_2$
S-35: $CH_2{=}CHCOO(CH_2)_2Si(C_{10}H_{21})(OCH_3)_2$
S-36: $CH_2{=}CHCOO(CH_2)_2Si(CH_2C_6H_5)(OCH_3)_2$

Any surface modifier other than these compounds S-1 to S-36 may be used, and the surface modifier may be a silane compound having a reactive organic group capable of radical polymerization. These surface modifiers may be used alone or in combination.

The surface modifier may be used in any amount. The amount of the surface modifier is preferably 0.1 to 100 parts by mass relative to 100 parts by mass of unmodified metal oxide particles.

[4.3] Surface Modification of Metal Oxide Particles

In specific, a slurry (suspension of solid particles) containing unmodified metal oxide particles and a surface modifier is subjected to wet milling, to micronize the metal oxide particles and to achieve surface modification of the particles. The solvent is then removed, followed by powderization, to prepare surface-modified metal oxide particles.

The slurry is preferably a mixture of unmodified metal oxide particles (100 parts by mass), a surface modifier (0.1 to 100 parts by mass), and a solvent (50 to 5,000 parts by mass).

A wet-media disperser is used for the wet milling of the slurry.

The wet-media disperser has a container loaded with media beads and a stirring disk mounted vertically to a rotary shaft. The stirring disk rapidly spins to mill and disperse agglomerated metal oxide particles. The disperser may be of any type that can sufficiently disperse the metal oxide particles during the surface modification of the metal oxide particles. Various types of the disperser may be used, such as a vertical type, a horizontal type, a continuous type, and a batch type. Specific examples of the disperser include a sand mill, an Ultravisco mill, a pearl mill, a grain mill, a Dyno mill, an agitator mill, and a dynamic mill. Such a disperser pulverizes and disperses particles by impact cracking, friction, shear force, or shear stress provided by grinding media, such as balls or beads.

The beads used in the wet-media disperser may be spheres composed of, for example, glass, alumina, zircon, zirconia, steel, or flint. Particularly preferred beads are composed of zirconia or zircon. Although the diameter of the beads is usually about 1 to 2 mm, a preferred diameter is about 0.1 to 1.0 mm in the present invention.

The disk and the inner wall of the container of the wet-media disperser may be formed of any material, such as stainless steel, nylon, or ceramic. In the present invention, the disk and the inner wall of the container are preferably formed of a ceramic material, such as zirconia or silicon carbide.

[5] Other Additives

The protective layer according to the present invention may contain a component besides the radically polymerizable compound (binder resin), the charge transporting material, the polymerization initiator, and the metal oxide particles. For example, the surface protective layer may contain an antioxidant or lubricant particles (e.g., fluorine-containing resin particles). The fluorine-containing resin is preferably one or more resins appropriately selected from a tetrafluoroethylene resin, a trifluorochloroethylene resin, a hexafluoropropylene-chloroethylene resin, a vinyl fluoride resin, a vinylidene fluoride resin, a difluorodichloroethylene resin, and copolymers thereof. Particularly preferred are a tetrafluoroethylene resin and a vinylidene fluoride resin.

<<Conductive Support>>

Any conductive support can be used, as long as it has conductivity. Examples of the conductive support include drums and sheets formed of metals, such as aluminum, copper, chromium, nickel, zinc, and stainless steel; plastic films laminated with metal foil of aluminum or copper; plastic films provided with deposited layers of aluminum, indium oxide, or tin oxide; and metal and plastic films and paper sheets having conductive layers formed through application of a conductive substance alone or in combination with a binder resin.

<<Intermediate Layer>>

In the electrophotographic photoreceptor of the present invention, an intermediate layer having a barrier function and an adhesive function may be disposed between the conductive support and the photosensitive layer. The intermediate layer is preferably disposed for, for example, prevention of various failures.

The intermediate layer contains, for example, a binder resin (hereinafter may be referred to as "binder resin for intermediate layer") and optionally conductive particles or metal oxide particles.

Examples of the binder resin for intermediate layer include casein, poly(vinyl alcohol), nitrocellulose, ethylene-acrylic acid copolymers, polyamide resins, polyurethane resins, and gelatin. Of these, preferred are alcohol-soluble polyamide resins.

The intermediate layer may contain any conductive particles or metal oxide particles for controlling the resistance. Examples thereof include particles of metal oxides, such as alumina, zinc oxide, titanium oxide, tin oxide, antimony oxide, indium oxide, and bismuth oxide; and ultrafine particles of tin-doped indium oxide, antimony-doped tin oxide, and antimony-doped zirconium oxide.

Such metal oxide particles preferably have a number average primary particle size of 0.3 μm or less, more preferably 0.1 μm or less. The number average primary particle size of the metal oxide particles can be determined in the same way as the number average primary particle size of the metal oxide particles included in the protective layer.

These metal oxide particles may be used alone or in combination. A mixture of two or more metal oxide particles may be in the form of solid solution or fusion.

The amount of the conductive particles or the metal oxide particles is preferably 20 to 400 parts by mass, more preferably 50 to 350 parts by mass, relative to 100 parts by mass of the binder resin for intermediate layer.

The intermediate layer has a thickness of preferably 0.1 to 15 μm, more preferably 0.3 to 10 μm.

<<Charge Generating Layer>>

The charge generating layer contains a charge generating material and a binder resin (hereinafter may be referred to as a "binder resin for charge generating layer").

Examples of the charge generating material include, but are not limited to, azo pigments, such as Sudan Red and Diane Blue; quinone pigments, such as pyrenequinone and anthanthrone; quinocyanine pigments; perylene pigments; indigo pigments, such as indigo and thioindigo; polycyclic quinone pigments, such as pyranthrone and diphthaloylpyrene; and phthalocyanine pigments. Of these, polycyclic quinone pigments and titanylphthalocyanine pigments are preferred.

These charge generating materials may be used alone or in combination.

Examples of the binder resin for charge generating layer include, but are not limited to, known resins, such as polystyrene resins, polyethylene resins, polypropylene resins, acrylic resins, methacrylic resins, vinyl chloride resins, vinyl acetate resins, poly(vinyl butyral) resins, epoxy resins, polyurethane resins, phenolic resins, polyester resins, alkyd resins, polycarbonate resins, silicone resins, melamine resins, copolymer resins containing two or more of these resins (e.g., vinyl chloride-vinyl acetate copolymer resins and vinyl chloride-vinyl acetate-maleic anhydride copolymer resins), and polyvinylcarbazole resins. Of these, poly(vinyl butyral) resins are preferred.

The amount of the charge generating material contained in the charge generating layer is, for example, preferably 1 to 600 parts by mass, more preferably 50 to 500 parts by mass, relative to 100 parts by mass of the binder resin for charge generating layer.

The thickness of the charge generating layer may vary depending on, for example, the properties of the charge generating material, the properties of the binder resin for charge generating layer, or the amount of the binder resin contained in the layer. The thickness is preferably 0.01 to 5 μm, more preferably 0.05 to 3 μm.

<<Charge Transporting Layer>>

The charge transporting layer of the photosensitive layer according to the present invention contains a charge transporting material and a binder resin (hereinafter may be referred to as a "binder resin for charge transporting layer").

Examples of the charge transporting material contained in the charge transporting layer include triphenylamine derivatives, hydrazone compounds, styryl compounds, benzidine compounds, and butadiene compounds.

Examples of the binder resin for charge transporting layer include known resins, such as polycarbonate resins, polyacrylate resins, polyester resins, polystyrene resins, styrene-acrylonitrile copolymer resins, polymethacrylate resins, and styrene-methacrylate copolymer resins. Of these, polycarbonate resins are preferred. More preferred are polycarbonate resins, such as Bisphenol A (BPA)-based, Bisphenol Z (BPZ)-based, dimethyl BPA-based, and BPA-dimethyl BPA copolymer-based resins, from the viewpoints of cracking resistance, wear resistance, and charging characteristics.

The amount of the charge transporting material contained in the charge transporting layer is preferably 10 to 500 parts by mass, more preferably 20 to 250 parts by mass, relative to 100 parts by mass of the binder resin for charge transporting layer.

The thickness of the charge transporting layer may vary depending on the properties of the charge transporting material, the properties of the binder resin for charge transporting layer, or the amount of the binder resin contained in the layer. The thickness is preferably 5 to 40 μm, more preferably 10 to 30 μm.

The charge transporting layer may contain, for example, an antioxidant, an electron conductor, a stabilizer, or silicone oil. The antioxidant is preferably one disclosed in Japanese Unexamined Patent Application Publication No. 2000-305291. The electron conductor is preferably one disclosed in, for example, Japanese Unexamined Patent Application Publication No. S50-137543 or S58-76483.

<<Production of Electrophotographic Photoreceptor>>

The present invention provides a method of producing an electrophotographic photoreceptor including a conductive support, a photosensitive layer, and a protective layer disposed in sequence, the method involving a step of forming the protective layer by curing, through ultraviolet rays irradiation, a composition containing a radically polymerizable compound, a charge transporting material exhibiting a maximal absorption wavelength of 405±50 nm, and a photopolymerization initiator of a single-molecule system. The properties of the charge transporting material and the photopolymerization initiator satisfy the Expression (A).

The electrophotographic photoreceptor of the present invention can be produced through, for example, the steps described below.

Step (1): formation of an intermediate layer by application of a coating liquid for intermediate layer onto an outer surface of a conductive support, followed by drying.

Step (2): formation of a charge generating layer by application of a coating liquid for charge generating layer onto the surface of the intermediate layer formed on the conductive support, followed by drying.

Step (3): formation of a charge transporting layer by application of a coating liquid for charge transporting layer onto the surface of the charge generating layer formed on the intermediate layer, followed by drying.

Step (4): formation of a protective layer by application of a coating liquid for protective layer onto the surface of the charge transporting layer formed on the charge generating layer to form a coating film, followed by curing of the coating film through ultraviolet rays irradiation.

These steps will now be described in detail.

(Step (1): Formation of Intermediate Layer)

The intermediate layer can be formed as follows: a binder resin for intermediate layer is dissolved in a solvent to prepare a coating liquid (hereinafter may be referred to as "coating liquid for intermediate layer"); conductive particles or metal oxide particles are optionally dispersed in the solution; the coating liquid is applied onto the conductive support to form a coating film having a specific thickness; and the coating film is dried.

The conductive particles or the metal oxide particles may be dispersed in the coating liquid for intermediate layer with any device. Examples of the device include, but are not limited to, an ultrasonic disperser, a ball mill, a sand mill, and a homomixer.

The coating liquid for intermediate layer can be applied by any known coating process. Examples of the process include dip coating, spray coating, spinner coating, bead coating, blade coating, beam coating, slide hopper coating, and circular slide hopper coating.

The coating film may be dried by a technique appropriately determined depending on the type of the solvent or the thickness of the film. Thermal drying is preferred.

The solvent used for formation of the intermediate layer may be of any type that can effectively disperse the conductive particles or the metal oxide particles and that can dissolve a binder resin for intermediate layer. Examples of preferred solvents include alcohols having one to four carbon atoms, such as methanol, ethanol, n-propyl alcohol, isopropyl alcohol, n-butanol, t-butanol, and sec-butanol, which exhibit high solubility for the binder resin and high coating characteristics. Any auxiliary solvent may be used in combination with the aforementioned solvent for improving storage stability or the dispersibility of particles. Examples of effective auxiliary solvents include benzyl alcohol, toluene, dichloromethane, cyclohexanone, and tetrahydrofuran.

The concentration of the binder resin in the coating liquid for intermediate layer is appropriately determined depending on the thickness of the intermediate layer or the rate of formation of the layer.

(Step (2): Formation of Charge Generating Layer)

The charge generating layer can be formed as follows: a binder resin for charge generating layer is dissolved in a solvent to prepare a solution; a charge generating material is dispersed in the solution to prepare a coating liquid (hereinafter may be referred to as "coating liquid for charge generating layer"); the coating liquid is applied onto the intermediate layer to form a coating film having a specific thickness; and the coating film is dried.

The charge generating material may be dispersed in the coating liquid for charge generating layer with any device. Examples of the device include, but are not limited to, an ultrasonic disperser, a ball mill, a sand mill, and a homomixer.

The coating liquid for charge generating layer can be applied by any known coating process. Examples of the process include dip coating, spray coating, spinner coating, bead coating, blade coating, beam coating, slide hopper coating, and circular slide hopper coating.

The coating film may be dried by a technique appropriately determined depending on the type of the solvent or the thickness of the film. Thermal drying is preferred.

Examples of the solvent used for formation of the charge generating layer include, but are not limited to, toluene, xylene, dichloromethane, 1,2-dichloroethane, methyl ethyl ketone, cyclohexane, ethyl acetate, t-butyl acetate, methanol, ethanol, propanol, butanol, methyl cellosolve, 4-methoxy-4-methyl-2-pentanone, ethyl cellosolve, tetrahydrofuran, 1,4-dioxane, 1,3-dioxolane, pyridine, and diethylamine.

(Step (3): Formation of Charge Transporting Layer)

The charge transporting layer can be formed as follows: a binder resin for charge transporting layer and a charge transporting material are dissolved in a solvent to prepare a coating liquid (hereinafter may be referred to as "coating liquid for charge transporting layer"); the coating liquid is applied onto the charge generating layer to form a coating film having a specific thickness; and the coating film is dried.

The coating liquid for charge transporting layer can be applied by any known coating process. Examples of the process include dip coating, spray coating, spinner coating, bead coating, blade coating, beam coating, slide hopper coating, and circular slide hopper coating.

The coating film may be dried by a technique appropriately determined depending on the type of the solvent or the thickness of the film. Thermal drying is preferred.

Examples of the solvent used for formation of the charge transporting layer include, but are not limited to, toluene, xylene, dichloromethane, 1,2-dichloroethane, methyl ethyl ketone, cyclohexanone, ethyl acetate, butyl acetate, methanol, ethanol, propanol, butanol, tetrahydrofuran, 1,4-dioxane, 1,3-dioxolane, pyridine, and diethylamine.

(Step (4): Formation of Protective Layer)

The protective layer according to the present invention is formed by curing, through ultraviolet rays irradiation, a composition containing a radically polymerizable compound, a charge transporting material exhibiting a maximal absorption wavelength of 405±50 nm, and a photopolymerization initiator of a single-molecule system. The properties of the charge transporting material and the photopolymerization initiator satisfy the Expression (A).

In specific, the protective layer can be formed as follows: a radically polymerizable compound, a charge transporting material exhibiting a maximal absorption wavelength of 405±50 nm, a photopolymerization initiator of a single-molecule system, and optional components (metal oxide particles and another component) are added to a known solvent to prepare a coating liquid (hereinafter may be referred to as "coating liquid for protective layer"); the coating liquid for protective layer is applied onto the surface of the charge transporting layer formed in step (3) to form a coating film; the coating film is dried; and the coating film is irradiated with ultraviolet rays for curing of the radically polymerizable compound contained in the coating film.

In curing the protective layer, the coating film is preferably irradiated with ultraviolet rays to generate radicals for polymerization reaction, and crosslinkages are formed through intermolecular and intramolecular crosslinking reaction for curing of the compound. The radically polymerizable compound is thereby formed into a crosslinked cured resin.

In the coating liquid for protective layer, the amount of the metal oxide particles is preferably 5 to 60 parts by volume, more preferably 10 to 60 parts by volume, relative to 100 parts by volume of all monomers for forming the binder resin (radically polymerizable compound).

The amount of the charge transporting material is preferably 5 to 75 parts by volume, more preferably 5 to 50 parts by volume, relative to 100 parts by volume of all monomers for forming the binder resin (radically polymerizable compound).

The amount of the photopolymerization initiator is preferably 0.1 to 20 parts by mass, more preferably 0.5 to 10 parts by mass, relative to 100 parts by mass of all monomers for forming the binder resin (radically polymerizable compound).

The metal oxide particles and the charge transporting material may be dispersed in the coating liquid for protective layer with any device. Examples of the device include, but are not limited to, an ultrasonic disperser, a ball mill, a sand mill, and a homomixer.

The solvent used for formation of the protective layer may be of any type that can dissolve or disperse the radically polymerizable compound, the metal oxide particles, and the charge transporting material. Examples of the solvent include, but are not limited to, methanol, ethanol, n-propyl alcohol, isopropyl alcohol, n-butanol, t-butanol, sec-butanol, benzyl alcohol, toluene, xylene, dichloromethane, methyl ethyl ketone, cyclohexane, ethyl acetate, butyl acetate, methyl cellosolve, ethyl cellosolve, tetrahydrofuran, 1,4-dioxane, 1,3-dioxolane, pyridine, and diethylamine.

The coating liquid for protective layer can be applied by any known coating process. Examples of the process include dip coating, spray coating, spinner coating, bead coating, blade coating, beam coating, slide hopper coating, and circular slide hopper coating.

The coating film may be subjected to curing without drying. Preferably, the curing is performed after natural drying or thermal drying.

The drying conditions may be appropriately determined depending on the type of the solvent or the thickness of the coating film. The drying temperature is preferably room temperature (25° C.) to 180° C., particularly preferably 80 to 140° C. The drying period is preferably 1 to 200 minutes, particularly preferably 5 to 100 minutes.

Any ultraviolet ray source may be used. Examples of the ultraviolet ray source include low-pressure mercury lamps, middle-pressure mercury lamps, high-pressure mercury lamps, ultrahigh-pressure mercury lamps, carbon-arc lamps, metal halide lamps, xenon lamps, and flash (pulsed) xenon lamps.

The conditions of emitting ultraviolet rays may vary depending on the type of the lamp. For example, the dose of ultraviolet rays is usually 5 to 500 mJ/cm$^2$, preferably 5 to 100 mJ/cm$^2$.

The power of the lamp is preferably 0.1 to 5 kW, particularly preferably 0.5 to 3 kW.

The emission period for achieving a necessary dose of ultraviolet rays is preferably 0.1 seconds to 10 minutes, more preferably 0.1 seconds to 5 minutes, from the viewpoint of operational efficiency.

In the step of forming the protective layer, the coating film may be dried before, during, or after emission of ultraviolet rays. The timing of drying may be appropriately determined in combination with the ultraviolet ray emission conditions.

<<Image-Forming Apparatus>>

The image forming apparatus of the present invention includes the electrophotographic photoreceptor described above. Furthermore, the image forming apparatus of the present invention preferably includes a first charger to charge the surface of the electrophotographic photoreceptor, an exposing unit to form an electrostatic latent image on the surface of the electrophotographic photoreceptor, a developer to develop the electrostatic latent image with a toner into a toner image, a transferring unit to transfer the toner image onto a sheet, a second charger to charge the surface of the electrophotographic photoreceptor after transferring the toner image onto a sheet, and a cleaner to remove the residual toner on the electrophotographic photoreceptor.

Figure 2:
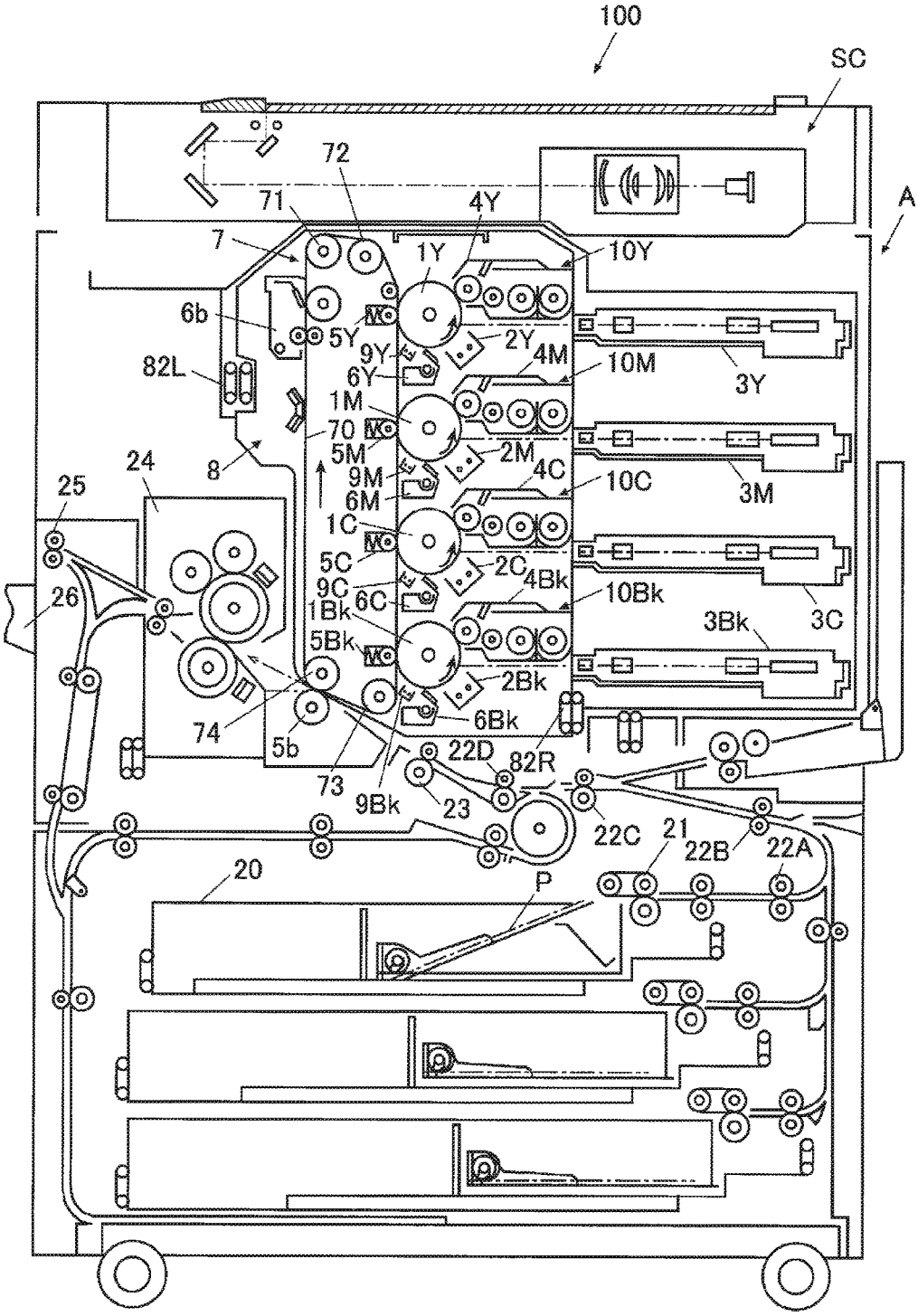
FIG. 2 is a schematic illustration of an exemplary configuration of an image forming apparatus including the electrophotographic photoreceptor of the present invention.

FIG. 2 is a cross-sectional view of the configuration of an image forming apparatus including the electrophotographic photoreceptor of the present invention.

The image forming apparatus 100, which is called a tandem color image forming apparatus, includes four image-formers 10Y, 10M, 10C, and 10Bk, an endless-belt intermediate transferring unit 7, a sheet feeder 21, and a fixer 24. A document scanner SC is disposed above a body A of the image forming apparatus 100.

The image-former 10Y for forming a yellow image includes a first charger 2Y, an exposing unit 3Y, a developer 4Y, a primary transferring roller 5Y, a second charger 9Y, and a cleaner 6Y, which are disposed sequentially around a drum photoreceptor 1Y along the rotating direction of the photoreceptor 1Y. The image-former 10M for forming a magenta image includes a first charger 2M, an exposing unit 3M, a developer 4M, a primary transferring roller 5M, a second charger 9M, and a cleaner 6M, which are disposed sequentially around a drum photoreceptor 1M along the rotating direction of the photoreceptor 1M. The image-former 10C for forming a cyan image includes a first charger 2C, an exposing unit 3C, a developer 4C, a primary transferring roller 5C, a second charger 9C, and a cleaner 6C, which are disposed sequentially around a drum photoreceptor 1C along the rotating direction of the photoreceptor 1C. The image-former 10Bk for forming a black image includes a first charger 2Bk, an exposing unit 3Bk, a developer 4Bk, a primary transferring roller 5Bk, a second charger 9Bk, and a cleaner 6Bk, which are disposed sequentially around a drum photoreceptor 1Bk along the rotating direction of the photoreceptor 1Bk. The electrophotographic photoreceptor of the present invention serves as the photoreceptors 1Y, 1M, 1C, and 1Bk.

The image-formers 10Y, 10M, 10C, and 10Bk have the same configuration except for the color of toner images formed on the photoreceptors 1Y, 1M, 1C, and 1Bk, respectively. Thus, the following description focuses on the image-former 10Y and the description of the image-formers 10M, 10C, and 10Bk are omitted.

The image-former 10Y includes the first charger 2Y, the exposing unit 3Y, the developer 4Y, the primary transferring roller 5Y, the second charger 9Y, and the cleaner 6Y, which are disposed around the photoreceptor 1Y (image retainer). The image-former 10Y forms a yellow (Y) toner image on the photoreceptor 1Y. In the present embodiment, at least the photoreceptor 1Y, the first charger 2Y, the developer 4Y, the second charger 9Y, and the cleaner 6Y are integrated in the image-former 10Y.

The first charger 2Y applies a uniform potential to the photoreceptor 1Y. For example, the charger of corona discharge mechanism is employed.

The exposing unit 3Y exposes the photoreceptor 1Y provided with the uniform potential by the first charger 2Y in response to image signals (yellow) to form an electrostatic latent image corresponding to the yellow image. The exposing unit 3Y includes light-emitting devices (LEDs) arrayed in the axial direction of the photoreceptor 1Y and an imaging element, or includes a laser optical system.

The developer 4Y is composed of a developing sleeve that includes, for example, a built-in magnet and rotates while retaining a developer, and a voltage-applying device that applies a DC and/or AC bias voltage between the developing sleeve and the photoreceptor 1Y.

The primary transfer roller 5Y is a device to transfer the toner image formed on the photoreceptor 1Y to the intermediate transferring body 70 in the endless-belt form. The primary transfer roller 5Y is arranged in such a manner to abut the intermediate transferring body 70.

The second charger 9Y charges (discharges) the surface of the photoreceptor 1Y after transferring the toner image onto the intermediate transferring body 70 as a pre-cleaner. For example, the charger of corona discharge mechanism is employed as the second charger 9Y.

The image forming apparatus 100 according to the present invention is provided with not only the electrophotographic photoreceptor according to the present invention but also the second charger 9Y. Sufficiently long service life and high image quality can be thereby achieved in such electrophotographic photoreceptor. Because the image forming apparatus 100 is provided with the electrophotographic photoreceptor according to the present invention, sufficiently long service life and high image quality can be thereby achieved even when the second charger 9Y is not provided or used.

The cleaner 6Y is composed of a cleaning blade and a brush roller disposed upstream of the cleaning blade.

The endless-belt intermediate transferring unit 7 includes an intermediate transferring body 70 in the endless-belt form (a semiconductive endless belt as a second image retainer) wound around and rotatably supported by multiple rollers 71, 72, 73, and 74. The endless-belt intermediate transferring unit 7 is provided with a cleaner 6*b* disposed on the intermediate transferring body 70. The cleaner 6*b* removes the toner.

The image-formers 10Y, 10M, 10C, and 10Bk, and the intermediate transferring unit 7 are accommodated in a housing 8. The housing 8 has a structure which can be drawn from the apparatus body A via rails 82L and 82R.

The fixer 24 is of, for example, a heat roller fixing type that is composed of a heating roller including a heat source therein and a pressurizing roller disposed in a state being pressed to the heating roller so as to form a fixing nip portion.

Although the image-forming apparatus 100 in the above-described embodiment is a color laser printer, the photoreceptor of the present invention can also be applied to monochrome laser printers, copiers, and multifunction peripherals. The exposure light source may be a light source other than a laser, such as an LED light source.

<<Image Forming Method>>

The image forming method according to the present invention includes usage of the electrophotographic photoreceptor according to the present invention.

Specifically, image forming is performed using the image forming apparatus 100 provided with the electrophotographic photoreceptor according to the present invention as follows.

First, the surfaces of the photoreceptors 1Y, 1M, 1C, and 1Bk are negatively charged by the first chargers 2Y, 2M, 2C, and 2Bk. The surfaces of the photoreceptors 1Y, 1M, 1C, and 1Bk are exposed by the exposing units 3Y, 3M, 3C, and 3Bk based on the corresponding image signals to form electrostatic latent images. The surfaces of the photoreceptors 1Y, 1M, 1C, and 1Bk are developed with toners by the developers 4Y, 4M, 4C, and 4Bk to form toner images.

Using the primary transfer rollers 5Y, 5M, 5C, and 5Bk, the toner images of the respective colors formed on the photoreceptors 1Y, 1M, 1C, and 1Bk are sequentially transferred onto the rotating intermediate transferring body 70 to form color images on the intermediate transferring body 70 (primary transfer).

The surfaces of the photoreceptors 1Y, 1M, 1C, and 1Bk are discharged by the second chargers 9Y, 9M, 9C, 9Bk. After discharging, the residual toner on the surface of the photoreceptors 1Y, 1M, 1C, and 1Bk is removed by the cleaners 6Y, 6M, 6C, and 6Bk. The surfaces of the photoreceptors 1Y, 1M, 1C, and 1Bk are charged by the chargers 2Y, 2M, 2C, and 2Bk for the next image formation.

A sheet P is fed from a sheet feeding cassette 20 by the feeder 21 through a plurality of intermediate rollers 22A, 22B, 22C, and 22D and a resist roller 23 to a secondary transfer unit 5*b*. The secondary transfer unit 5*b* transfers color toner images onto the sheet P (secondary transfer).

The sheet P having the transferred color images is fixed by the fixer 24, and is pinched between ejecting rollers 25 and is ejected onto a sheet receiving tray 26. After the sheet P is separated from the intermediate transferring body 70, the residual toner on the intermediate transferring body 70 is removed by the cleaner 6*b*.

An image can be thereby formed on the sheet P.

EXAMPLES

The present invention will now be described in detail by way of Examples, which should not be construed to limit the present invention. It is noted that "part(s)" and "%" in Examples indicate "part(s) by mass" and "% by mass", respectively, unless defined otherwise.

<<Production of Electrophotographic Photoreceptor 101>>

(Preparation of Conductive Support)

A conductive support was prepared through milling of the surface of a cylindrical aluminum support having a diameter of 80 mm.

(Formation of Intermediate Layer)

A dispersion having the following composition was 1.5-fold diluted with the same solvent mixture as described below and allowed to stand still overnight, followed by filtration using Rigimesh 5 μm filter (manufactured by Nihon Pall Ltd.), to prepare a coating liquid for intermediate layer.

| | |
|---|---|
| Binder: Polyamide resin CM8000 (manufactured by Toray Industries Inc.) | 100 parts by mass |
| Metal oxide particles: Titanium oxide SMT500SAS (manufactured by TAYCA Corporation) | 120 parts by mass |
| Metal oxide particles: Titanium oxide SMT150MK (manufactured by TAYCA Corporation) | 155 parts by mass |
| Solvent: ethanol/n-PrOH/tetrahydrofuran (proportions by volume: 60:20:20) | 1,290 parts by mass |

The dispersion was prepared through mixing of these materials with a sand mill (disperser) for five hours by a batch process.

After dispersion, the coating liquid for intermediate layer was applied onto the conductive support by dip coating, to form an intermediate layer having a thickness of 2 μm after drying.

(Formation of Charge Generating Layer)

A mixture of the following composition was dispersed with a sand mill for ten hours to prepare the coating liquid for charge generating layer. The prepared coating liquid for charge generating layer was applied onto the intermediate layer by dip coating, to form a charge generating layer having a thickness of 0.3 μm after drying.

| | |
|---|---|
| Charge generating material: titanylphthalocyanine pigment (titanylphthalocyanine pigment having at least a maximum diffraction peak at 27.3° as measured by Cu—Kα X-ray diffractometry) | 20 parts by mass |
| Binder: poly(vinyl butyral) resin (#6000-C: manufactured by DENKA Co. Ltd.) | 10 parts by mass |
| Solvent: t-Butyl acetate | 700 parts by mass |
| Solvent: 4-Methoxy-4-methyl-2-pentanone | 300 parts by mass |

(Formation of Charge Transporting Layer)

A mixture of the following composition was dissolved to prepare the coating liquid for charge transporting layer. The prepared coating liquid for charge transporting layer was applied onto the charge generating layer by dip coating, to form a charge transporting layer having a thickness of 20 μm after drying. A photosensitive layer composed of the charge generating layer and the charge transporting layer is thereby formed.

| | |
|---|---|
| Charge transporting material: CMT-1 | 225 parts by mass |
| Binder resin: polycarbonate (Z300: manufactured by Mitsubishi Gas Chemical Company, Inc.) | 300 parts by mass |
| Antioxidant: Irganox 1010 (manufactured by BASF Japan Ltd.) | 6 parts by mass |
| Solvent: tetrahydrofuran | 1,600 parts by mass |
| Solvent: Toluene | 400 parts by mass |
| Leveling agent: silicone oil (KF-54: manufactured by Shin-Etsu Chemical Co., Ltd.) | 1 part by mass |

(Formation of Protective Layer)

A reactive organic group is added to the metal oxide particles of silica by surface treatment as follows.

100 parts by mass of Silica particles (manufactured by Nippon Aerosil Co., Ltd., number average primary particle size of 20 nm), 30 parts by mass of the above-described surface modifier S-15 ($CH_2{=}C(CH_3)COO(CH_2)_3Si(OCH_3)_3$), and 300 parts by mass of a solvent mixture of toluene/isopropyl alcohol (=1/1 by mass ratio) were mixed. The mixture was placed in a sand mill together with zirconia beads and agitated at about 40° C. and 1,500 rpm for 15 minutes and then dried at 120° C. for three hours, to prepare surface-treated silica particles. The surfaces of the prepared surface-treated silica particles were confirmed to be coated by the surface modifier S-15, through measurement of the reduction amount (by mass) of the silica particles during heating from 25° C. to 600° C. using automatic TG/DTA Simultaneous Measuring Instrument (DTG-60A, made by Shimadzu Co. Ltd.)

Subsequently, the mixture of the following composition was thoroughly mixed under agitation to prepare a coating liquid for protective layer by sufficient dissolution and dispersion. The prepared coating liquid for protective layer was applied onto the photosensitive layer with a circular slide hopper coating machine, irradiated with ultraviolet rays (wavelength: 365 nm, 405 nm, etc.) with a xenon lamp for one minute, and dried at 80° C. for 70 minutes. The illumination of wavelength of 365 nm measured by UV intensity meter UIT-201 (manufactured by USHIO Inc.) was 100 mW/cm$^2$, to form a protective layer having a thickness of 3.0 μm after drying.

| | |
|---|---|
| Electrophotographic photoreceptor 101 was thereby produced. Surface-treated silica particles described above | 54 parts by mass |
| Radically polymerizable compound: exemplary compound M1 described above | 100 parts by mass |
| Charge transporting material: CTM-1 | 43 parts by mass |
| Photopolymerization initiator: Irgacure OXE01 (manufactured by BASF Japan Ltd., B-1 described above) | 9.81 parts by mass |
| Solvent: 2-butanol | 160 parts by mass |
| Solvent: 2-Methyltetrahydrofuran | 160 parts by mass |

Regarding the charge transporting material and the photopolymerization initiator included in the protective layer, ⊿G calculated according to the Expression (A) was −0.38 [eV].

<<Production of Electrophotographic Photoreceptor 102>>

Electrophotographic photoreceptor 102 was produced as in electrophotographic photoreceptor 101 except that the charge transporting material included in the coating liquid for protective layer was replaced with CTM-3.

<<Production of Electrophotographic Photoreceptor 103>>

Electrophotographic photoreceptor 103 was produced as in electrophotographic photoreceptor 101 except that the charge transporting material and the photopolymerization initiator included in the coating liquid for protective layer were replaced with CTM-3 and Irgacure 819 (manufactured by BASF Japan Ltd.), respectively.

<<Production of Electrophotographic Photoreceptor 104>>

Electrophotographic photoreceptor 104 was produced as in electrophotographic photoreceptor 101 except that metal oxide particles were not added to the coating liquid for protective layer.

<<Production of Electrophotographic Photoreceptor 105>>

Electrophotographic photoreceptor 105 was produced as in electrophotographic photoreceptor 101 except that the metal oxide particles (silica particles) included in the coating liquid for protective layer were not subjected to surface treatment. The content of the silica particles with untreated surface included in the coating liquid for protective layer was 54 parts by mass.

<<Production of Electrophotographic Photoreceptors 106 and 107>>

Electrophotographic photoreceptors 106 and 107 were produced as in electrophotographic photoreceptor 101 except that the metal oxide particles included in the coating liquid for protective layer were replaced with $Al_2O_3$ (manufactured by CIK Nanotek Corporation, number average primary particle size: 30 nm) and $SnO_2$ (manufactured by CIK Nanotek Corporation, number average primary particle size: 20 nm), respectively.

<<Production of Electrophotographic Photoreceptor 108>>

Electrophotographic photoreceptor 108 was produced as in electrophotographic photoreceptor 101 except that the photopolymerization initiator included in the coating liquid for protective layer was replaced with a mixture (mass ratio: 1:1) of Irgacure OXE01 (manufactured by BASF Japan Ltd.) and Irgacure 819 (manufactured by BASF Japan Ltd.).

<<Production of Electrophotographic Photoreceptors 109 and 110 (Comparative Examples)>>

Electrophotographic photoreceptors 109 and 110 were produced as in electrophotographic photoreceptor 101 except that the photopolymerization initiator included in the coating liquid for protective layer was replaced with Irgacure 819 (manufactured by BASF Japan Ltd.) and Irgacure 379EG (manufactured by BASF Japan Ltd.), respectively.

<<Production of Electrophotographic Photoreceptor 111 (Comparative Example)>>

Electrophotographic photoreceptor 111 was produced as in electrophotographic photoreceptor 101 except that the photopolymerization initiator included in the coating liquid for protective layer was replaced with a two-molecule system photopolymerization initiator.

The two-molecule system photopolymerization initiator was a mixture of HABI (2,2'-bis(2-chlorophenyl)-4,4',5,5'-tetraphenyl-1,2'-biimidazole, manufactured by Tokyo Chemical Industry Co., Ltd.) and MBO (2-Mercaptobenzoxazole, manufactured by Tokyo Chemical Industry Co., Ltd.) (2:1 in mass ratio). MBO functions as a chain transfer agent and does not generate radicals by excitation through UV irradiation. That is, MBO does not relate to sensitization. Accordingly, ⊿G in Expression (A) was not calculated on the basis of the combination of the charge transporting material and MBO.

<<Production of Electrophotographic Photoreceptor 112 (Comparative Example)>>

Electrophotographic photoreceptor 112 was produced as in electrophotographic photoreceptor 101 except that the charge transporting material, the photopolymerization initiator, and the metal oxide particles included in the coating liquid for protective layer were replaced with Comparative CTM represented by the formula below, Irgacure 819 (manufactured by BASF Japan Ltd.), and $SnO_2$ (manufactured by CIK Nanotek Corporation, number average primary particle size: 20 nm), respectively.

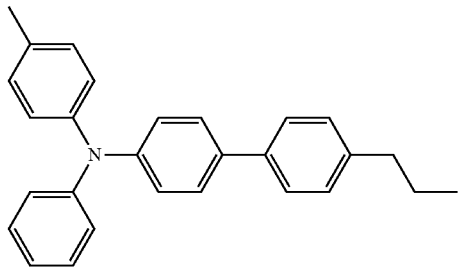

Comparative CTM

<<Evaluation of Electrophotographic Photoreceptor>>

The above-produced electrophotographic photoreceptors were evaluated as described below. The results of evaluation are illustrated in Table I.

A commercial printer "bizhub PRESS C1085" (manufactured by KONICA MINOLTA, INC.), which has basically the same configuration as that of the image forming apparatus illustrated in FIG. 2, was used as a machine for evaluation. Each of the above-produced electrophotographic photoreceptors was mounted in the machine for evaluation.

A durability test was performed involving continuous printing of a character image (image area percentage: 15%) on both sides of transversely fed size-A4 300,000 sheets in an environment of 23° C. and 50% RH. Potential stability and wear resistance (α value) were evaluated during or after the durability test.

(1) Evaluation of Poiential Stability

The initial potential for charging (before durability test) of the exposing unit in the machine for evaluation was adjusted to 600±50V. The amount of variation (⊿V) before and after the durability test was measured using the prove in the machine for evaluation and evaluated according to the following criteria.

A: ⊿V is less than 50V (good)

B: ⊿V is 50 V to 100 V (practically acceptable)

C: ⊿V is more than 100 V (impractical)

(2) Evaluation of Wear Resistance

The difference was measured between the thickness of photosensitive layers before and after the durability test to calculate a reduction in thickness per 100 krot (100,000 rotations) as α value.

The thickness was measured with an eddy-current thickness meter EDDY560C (manufactured by HELMUT FISCHER GmbH CO). The thickness of the photosensitive layer corresponds to the average of the thicknesses of randomly selected 10 layer portions of uniform thickness (excluding portions of irregular thickness (i.e., front and rear end portions of coating) on the basis a layer thickness profile).

An α value of 0.2 μm or less is an acceptable level in the present invention.

TABLE I

| Electro-photographic photoreceptor No. | Charge transporting material | Photo-polymerization Initiator | ΔG [eV] | Metal oxide particle: Kind of particle | Metal oxide particle: Reactive organic group | Evaluation: Potential stability | Evaluation: Wear resistance (α value) [μm] | Note |
|---|---|---|---|---|---|---|---|---|
| 101 | CTM-1 | Irgacure OXE01 | −0.38 | $SiO_2$ | Present | A | 0.14 | Present invention |
| 102 | CTM-3 | Irgacure OXE01 | −0.71 | $SiO_2$ | Present | B | 0.16 | Present invention |
| 103 | CTM-3 | Irgacure 819 | −0.51 | $SiO_2$ | Present | A | 0.18 | Present invention |
| 104 | CTM-1 | Irgacure OXE01 | −0.38 | — | — | A | 0.20 | Present invention |
| 105 | CTM-1 | Irgacure OXE01 | −0.38 | $SiO_2$ | Absent | A | 0.18 | Present invention |
| 106 | CTM-1 | Irgacure OXE01 | −0.38 | $Al_2O_3$ | Present | B | 0.14 | Present invention |
| 107 | CTM-1 | Irgacure OXE01 | −0.38 | $SnO_2$ | Present | B | 0.15 | Present invention |
| 108 | CTM-1 | Irgacure OXE01<br>Irgacure 819 | −0.38<br>−0.18 | $SiO_2$ | Present | A | 0.20 | Present invention |
| 109 | CTM-1 | Irgacure 819 | −0.18 | $SiO_2$ | Present | A | 3.30 | Comparative Example |
| 110 | CTM-1 | Irgacure 379EG | 0.65 | $SiO_2$ | Present | A | 4.10 | Comparative Example |
| 111 | CTM-1 | HABI<br>MBO | −0.55<br>— | $SiO_2$ | Present | B | 0.41 | Comparative Example |
| 112 | Comparative CTM | Irgacure 819 | −0.72 | $SnO_2$ | Present | C | 0.13 | Comparative Example |

As shown in TABLE I, the electrophotographic photoreceptors 101 to 108 has excellent potential stability and high wear resistance compared to the electrophotographic photoreceptors 109 to 112.

Although embodiments of the present invention have been described and illustrated in detail, it is clearly understood that the same is by way of illustration and example only and not limitation, the scope of the present invention should be interpreted by terms of the appended claims.

What is claimed is:

1. An electrophotographic photoreceptor comprising a conductive support, a photosensitive layer, and a protective layer disposed in sequence, wherein the protective layer comprises a cured product of a composition containing a radically polymerizable compound, a charge transporting material exhibiting a maximal absorption wavelength of 405±50 nm, and a photopolymerization initiator of a single-molecule system, a following Expression (A) is satisfied:

$$\Delta G = Eox(D/D^+) - Ered(A^-/A) - E^* \leq -0.2 \text{ [eV]} \quad \text{Expression (A):}$$

where ⊿G represents a free energy change, $Eox(D/D^+)$ represents an oxidation potential of the charge transporting material, $Ered(A^-/A)$ represents a reduction potential of the photopolymerization initiator, and E* represents an excitation energy of the charge transporting material, and the photopolymerization initiator comprises an acyl phosphine oxide structure or an O-acyl oxime structure.

2. The electrophotographic photoreceptor according to claim 1, wherein the protective layer contains a metal oxide particle.

3. The electrophotographic photoreceptor according to claim 2, wherein the metal oxide particle has a reactive organic group.

4. An image forming apparatus comprising the electrophotographic photoreceptor according to claim 1.

5. An image forming method using the electrophotographic photoreceptor according to claim 1.

6. A method of producing an electrophotographic photoreceptor comprising a conductive support, a photosensitive layer, and a protective layer disposed in sequence, the method comprising forming the protective layer by curing a composition through ultraviolet rays irradiation, the composition containing a radically polymerizable compound, a charge transporting material exhibiting a maximal absorption wavelength of 405±50 nm, and a photopolymerization initiator of a single-molecule system, wherein a following Expression (A) is satisfied:

$$\Delta G = Eox(D/D^+) - Ered(A^-/A) - E^* \leq -0.2 \text{ [eV]} \quad \text{Expression (A):}$$

where ⊿G represents a free energy change, $Eox(D/D^+)$ represents an oxidation potential of the charge transporting material, $Ered(A^-/A)$ represents a reduction potential of the photopolymerization initiator, and E* represents an excitation energy of the charge transporting material, and the photopolymerization initiator comprises an acyl phosphine oxide structure or an O-acyl oxime structure.

7. The electrophotographic photoreceptor according to claim 1, wherein the charge transport material is selected from the group consisting of:

CTM-141
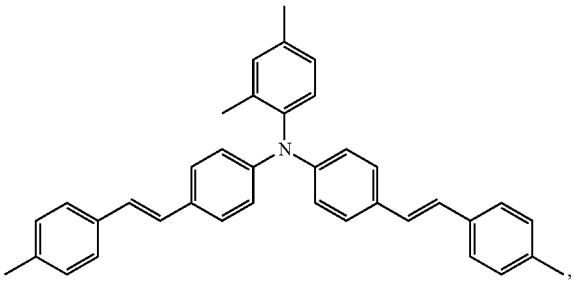
CTM-143
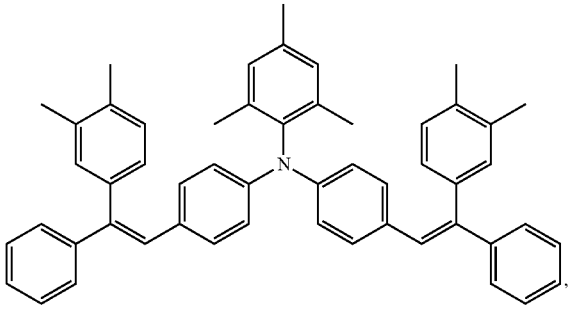
CTM-144
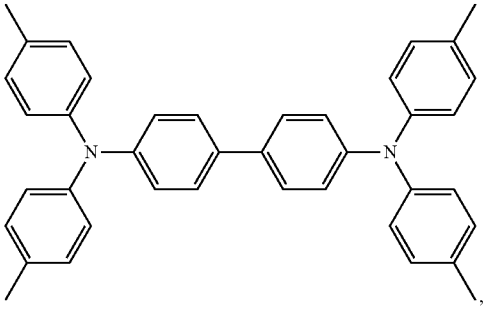
CTM-145
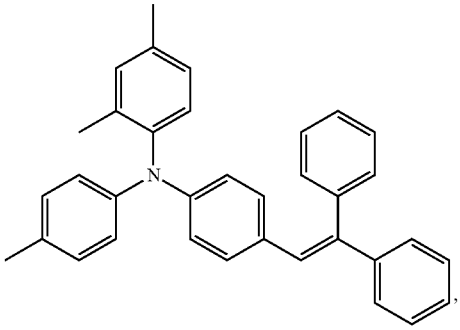
CTM-146
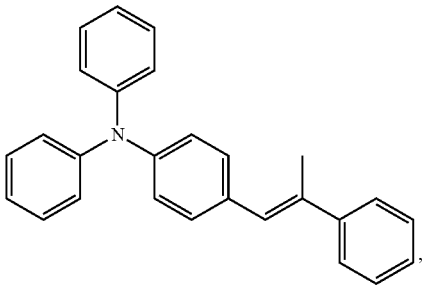
and
-continued
CTM-147
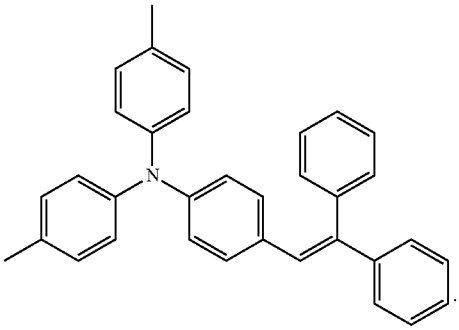
8. The method according to claim 6, wherein the charge transport material is selected from the group consisting of:
CTM-141
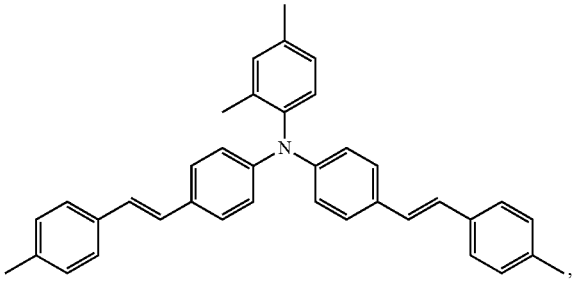
CTM-143
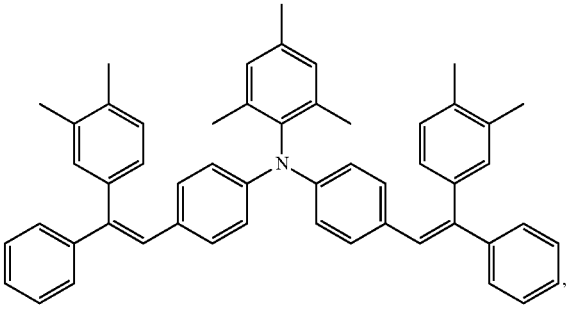
CTM-144
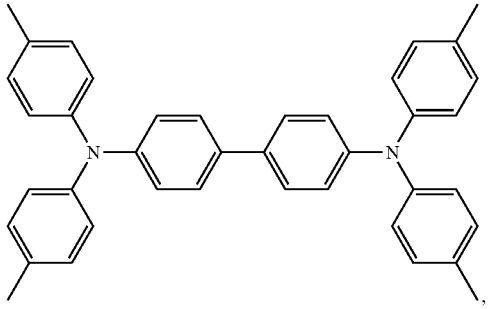

-continued
CTM-145
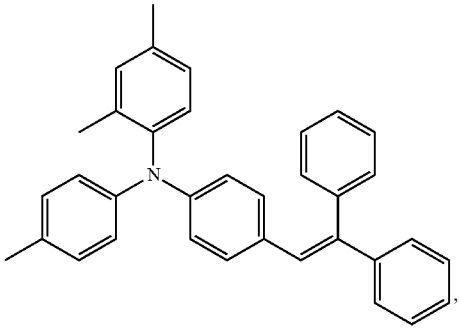
CTM-146
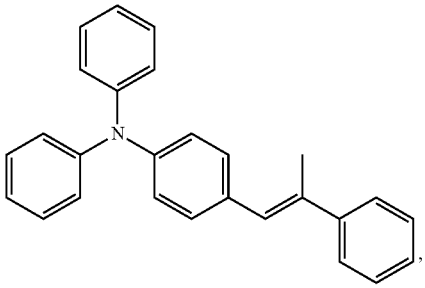
and
-continued
CTM-147
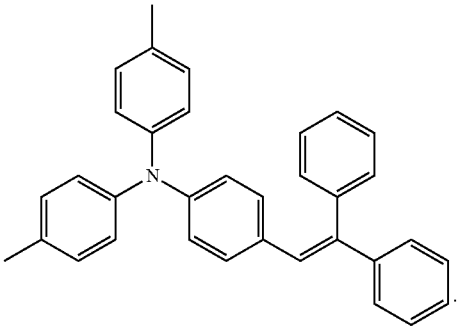
* * * * *